US005679023A

United States Patent [19]

Anderson, Jr. et al.

[11] Patent Number: 5,679,023

[45] Date of Patent: Oct. 21, 1997

[54] FEMALE CABLE CONNECTOR HEAD FOR RELOCATABLE WIRING SYSTEMS AND METHODS FOR MANUFACTURE THEREOF

[75] Inventors: Ormand Gilbert Anderson, Jr., Canton; William Wade Marder, Lithonia, both of Ga.

[73] Assignee: NSI Enterprises, Inc., Atlanta, Ga.

[21] Appl. No.: 518,532

[22] Filed: Aug. 23, 1995

[51] Int. Cl.[6] ..... H01R 11/00

[52] U.S. Cl. ..... 439/502; 439/215; 439/650; 362/147

[58] Field of Search ..... 439/211, 215, 439/502, 650, 654, 144, 368, 651; 362/147

[56] References Cited

U.S. PATENT DOCUMENTS

| | | | |
|---|---|---|---|
| 3,510,825 | 5/1970 | Quackenbush | 439/650 |
| 4,146,287 | 3/1979 | Jonsson | 439/368 |
| 4,219,868 | 8/1980 | Bowman et al. | 439/502 |
| 4,502,744 | 3/1985 | Garnett et al. | 439/650 |
| 4,875,871 | 10/1989 | Booty, Sr. et al. | 439/209 |
| 5,045,640 | 9/1991 | Riceman | 439/144 |
| 5,503,565 | 4/1996 | McCoy | 439/215 |
| 5,507,668 | 4/1996 | Lambrinow et al. | 439/502 |
| 5,562,469 | 10/1996 | Nienhuis et al. | 439/654 |
| 5,595,495 | 1/1997 | Johnson et al. | 439/215 |

*Primary Examiner*—Neil Abrams
*Assistant Examiner*—Brian J. Biggi
*Attorney, Agent, or Firm*—Kenneth E. Darnell

[57] ABSTRACT

A dual-port electrical cable female connector head primarily useful for branch circuit extension of and for fixture tapping into a relocatable wiring system, the female connector head of the invention is located at one end of a length of electrical cable which carries one or more circuits and into which lighting fixtures or other electrical loads are to be tapped at predetermined locations of the wiring system by connection to tapping ports formed in respective female connector heads. A male connector head joined to the length of cable at the other end thereof connects to a branch circuit port formed in a female connector head of an adjacent length of cable in the wiring system. The relocatable wiring system is thus formed along its length by repetitive units consisting of lengths of cable with one of the female connector heads of the invention being joined to one end of the cable and a male connector head being joined to the other end of the cable, the female connector head of the invention having two connection ports disposed in angular relationship to each other which is out of plane of the body of the female connector head with both ports being capable of use either as a tapping port or as a branch circuit port. The female connector head of the invention improves prior wire system connectors by providing a more compact, less expensive and more easily manufactured female connector head and which also exhibits a low profile in use and is manufactured using fewer discrete parts while displaying greater operational flexibility in use.

55 Claims, 10 Drawing Sheets

PRIOR ART
Fig. 1
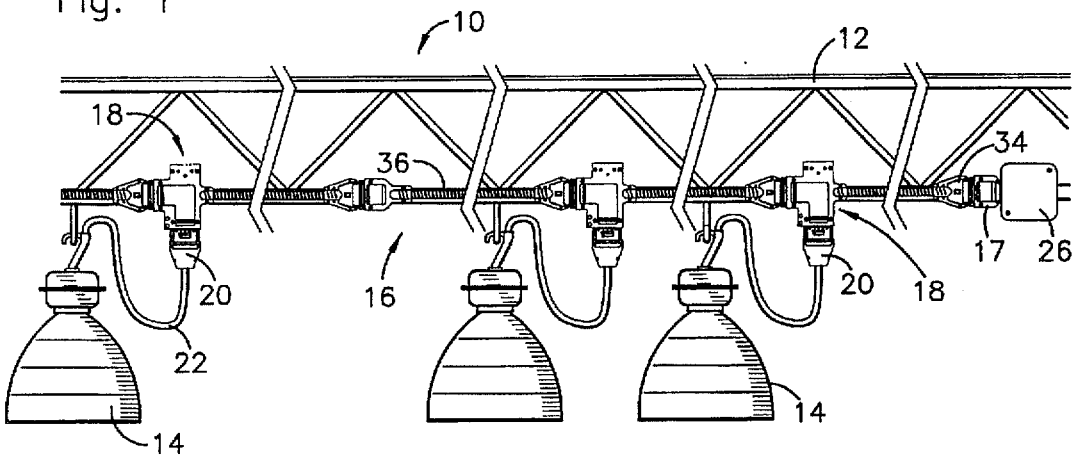
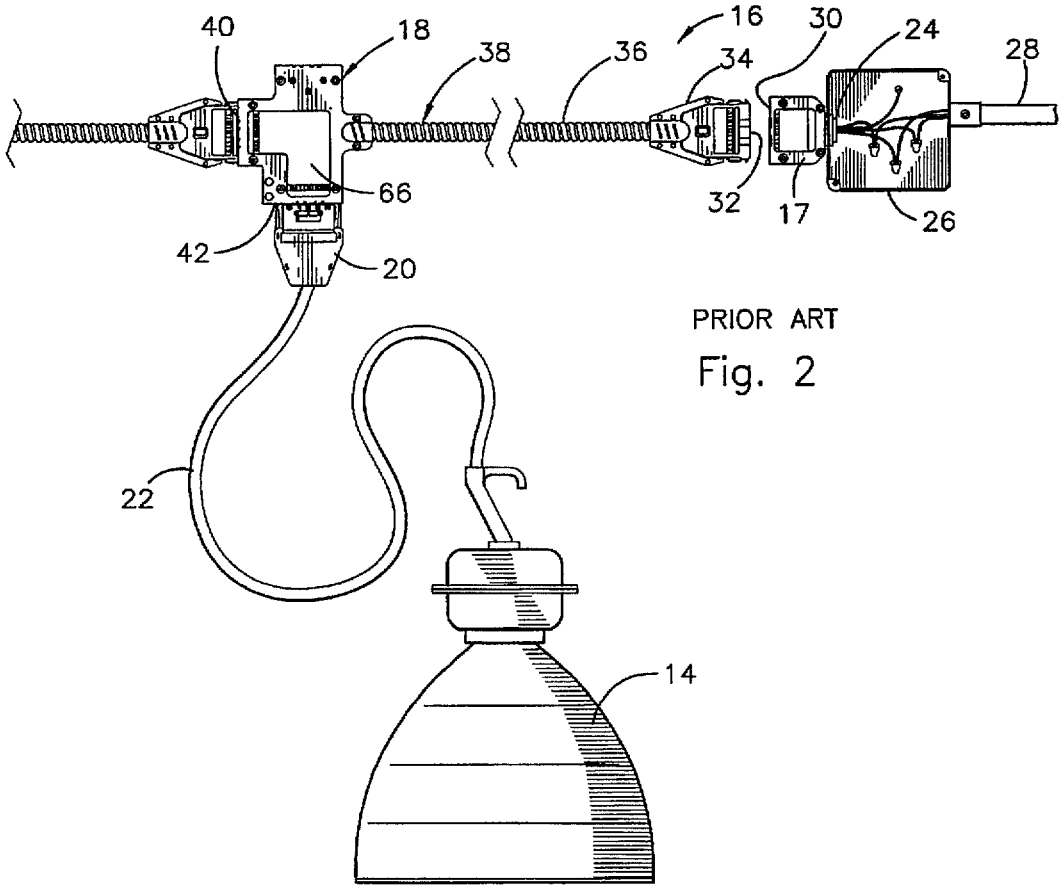
PRIOR ART
Fig. 2

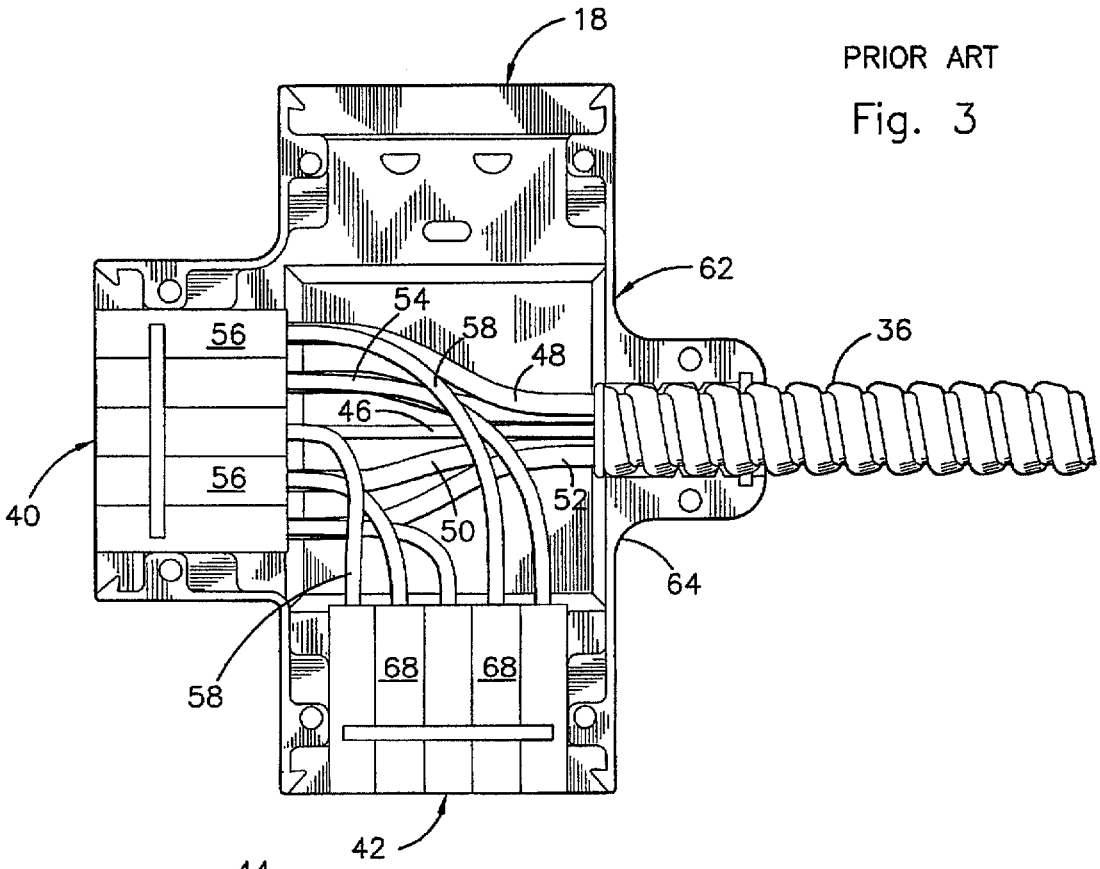
PRIOR ART
Fig. 3
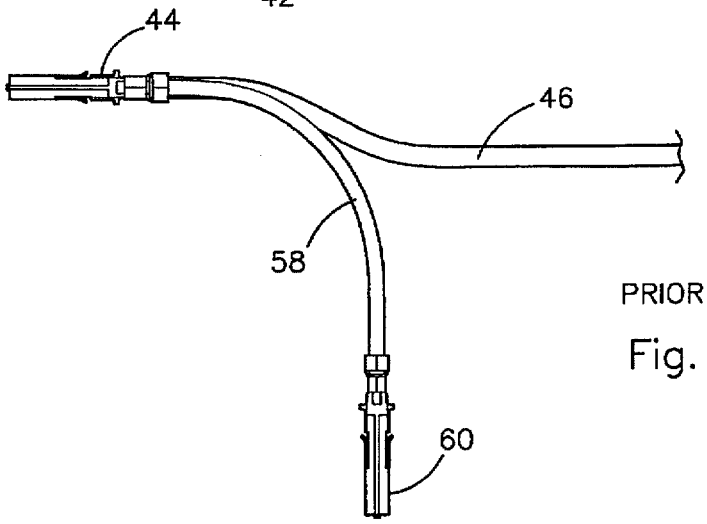
PRIOR ART
Fig. 4
Fig. 26a
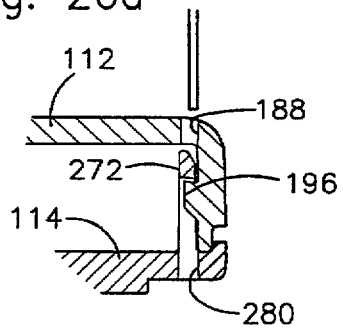
Fig. 26b
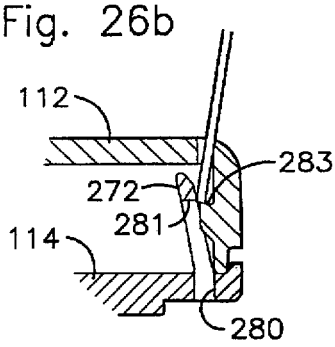

92
90
94
86
82
80
84
78
88
98
106
100
74

96
85

Fig. 9
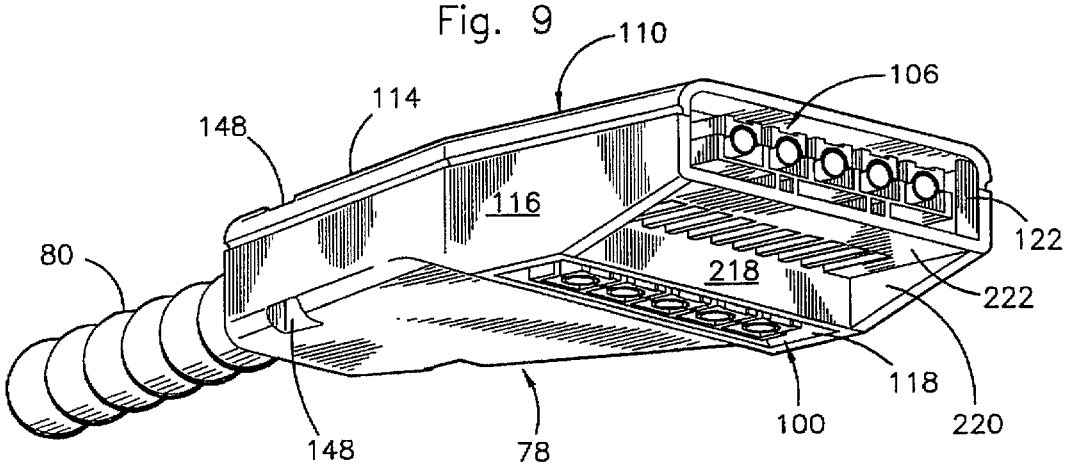
Fig. 11a
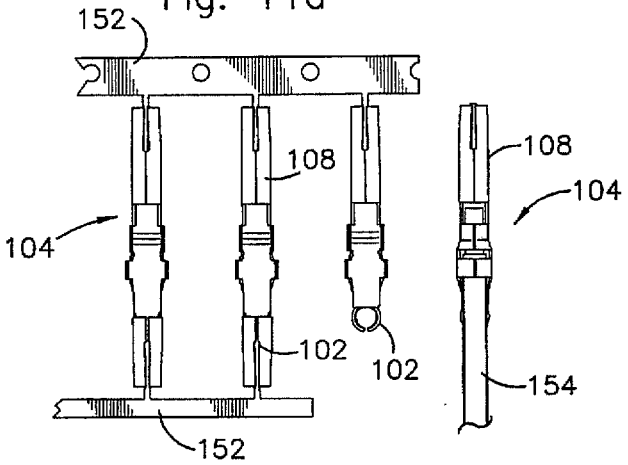
Fig. 11b
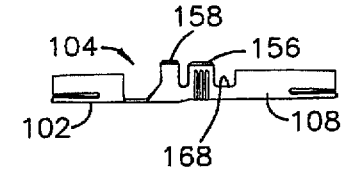
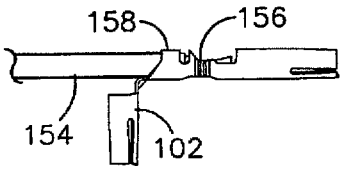
Fig. 11c
Fig. 12a
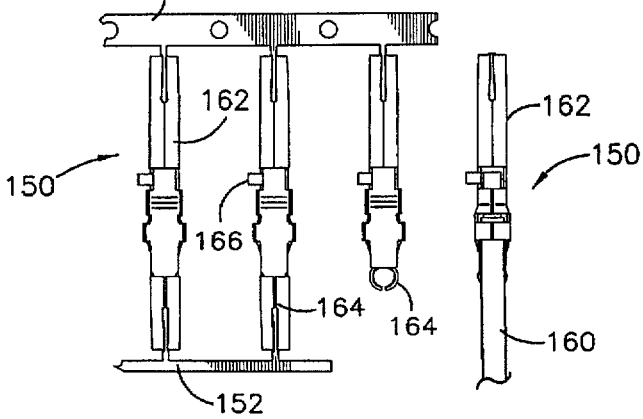
Fig. 12b
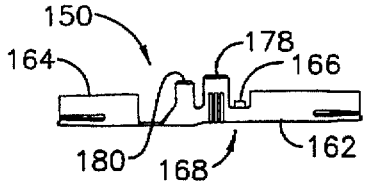
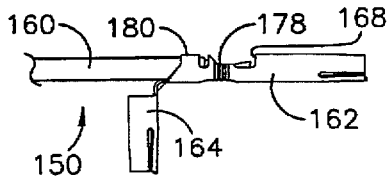
Fig. 12c Fig. 13
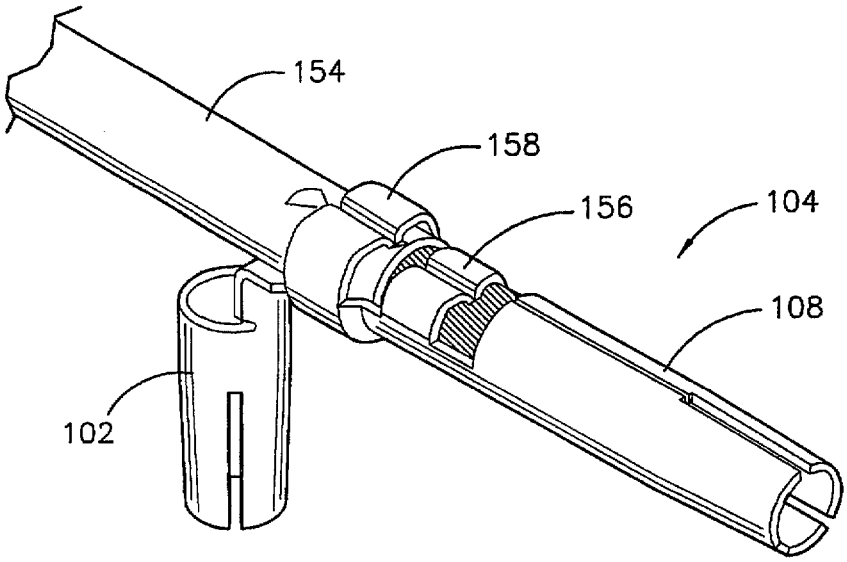
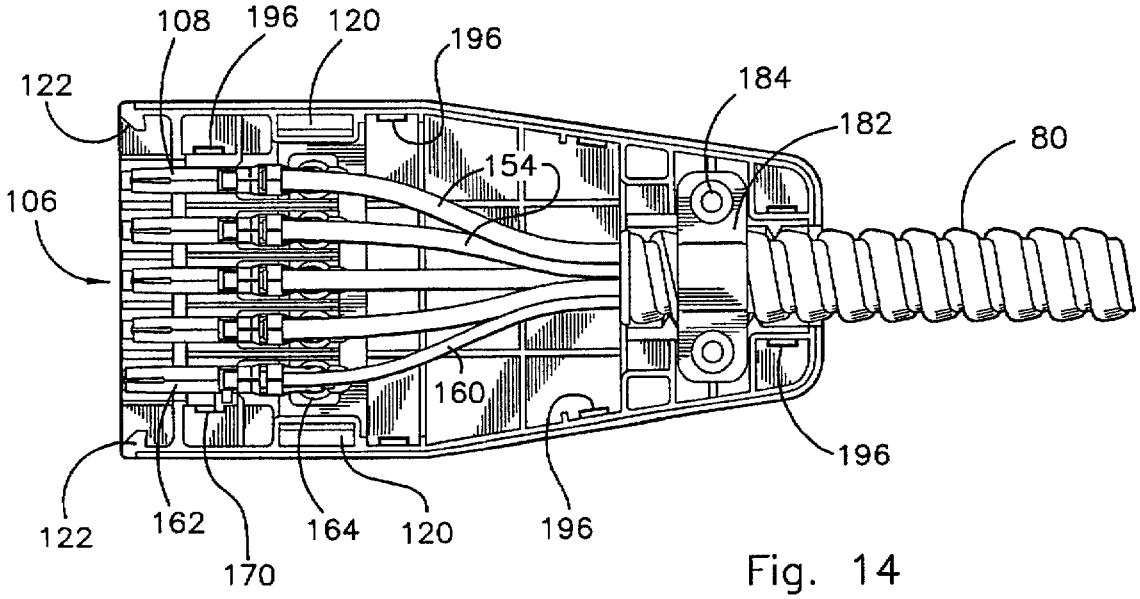
Fig. 14

Fig. 25
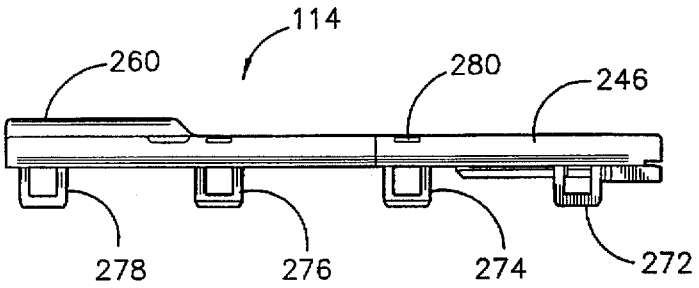
Fig. 21
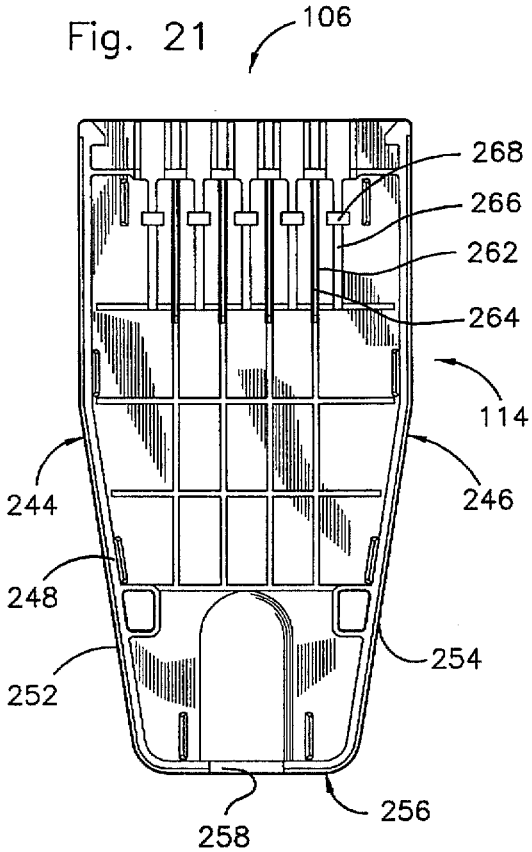
Fig. 23
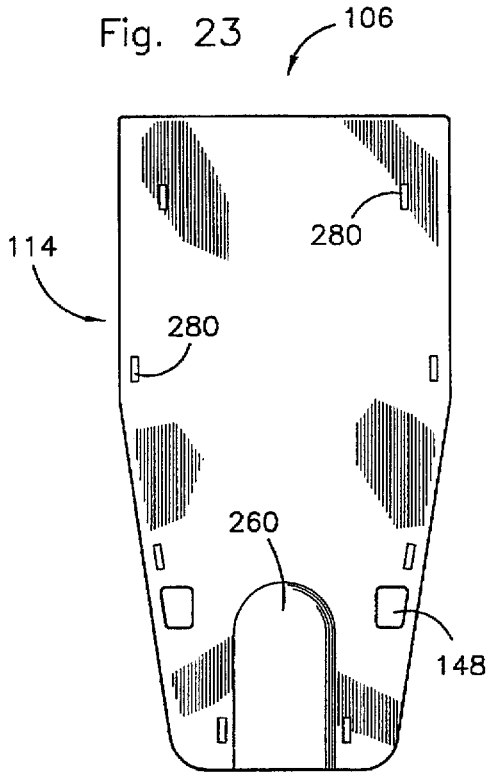
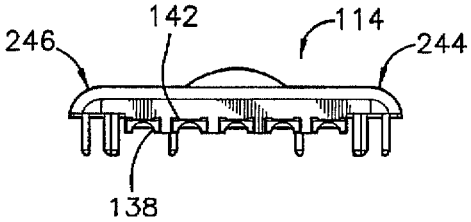
Fig. 22
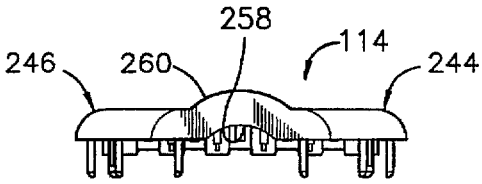
Fig. 24

FEMALE CABLE CONNECTOR HEAD FOR RELOCATABLE WIRING SYSTEMS AND METHODS FOR MANUFACTURE THEREOF

BACKGROUND OF THE INVENTION

1. Field of the Invention

The invention relates generally to relocatable wiring systems and particularly to such systems formed of circuit-bearing lengths of cable joined together by the connection of a female connector head and a male connector head at each juncture of the lengths of cable, each female connector head having a tapping port into which a lighting fixture or other electrical load can be connected to the system.

2. Description of the Prior Art

Installation of electrical wiring for the operation of lighting fixtures and other circuit loads is a well-known art long practiced in a variety of similar and basically simple ways. In the installation of an industrial high intensity discharge (HID) lighting system, as an example, conduits must first be installed with wire or cable then being pulled through the conduit. Fixtures are then hung and connected to the electrical system within the conduit with the fixtures then finally being energized. In such a prior art system, which is known in the art as hardwire industrial HID, it is apparent from the various installation steps that it is necessary to undertake three or more passes up and down a row of wiring in order to finally produce a row of operable lighting fixtures. A number of similar wiring systems exist not only for installation of HID lighting but also for installation of fluorescent lighting, incandescent lighting and other electrical loads. These prior art approaches to the installation of lighting in industrial and commercial situations require the application of a tremendous amount of labor to install the wire or cable and to connect the lighting fixtures or the like into the wiring system. When a wiring system requires the connection of industrial lighting fixtures into an installation, whether HID, incandescent or fluorescent, it is necessary in a hardwired system for an installer to also set a junction box and then additionally cut conduit and fix same to a superstructure within the building and then to set fixture mounting boxes, pull wire and cut and strip conductors even before the lighting fixtures themselves can be hung. After hanging of the fixtures, it is still necessary to connect conductors to each fixture. The operations thus described require three or more passes up and down each row of fixtures with the labor of installation accounting for 70 to 80 percent of the total branch circuitry job cost. A wiring system intalled by this conventional "pipe and wire process" has the additional disadvantage that it cannot be used for temporary lighting during facility construction and again for permanent lighting since the materials used in hardwiring processes are typically not reusable. Circuitry changes due to layout revision or expansion cannot readily be accommodated in prior art hardwiring systems due to a typical inability when using such prior art systems to reuse those materials which have been cut, such as conduit, for a dedicated circuit arrangement. Relocation of lighting fixtures or other electrical loads in these prior art hardwire systems is thus rendered difficult, it usually being necessary to begin the wiring process anew when fixture relocation is necessary. These prior art hardwiring systems also require a number of different structural elements which must be kept in inventory, these structural elements including conduit, wire, couplings, connectors, wirenuts and other miscellaneous materials. Those disadvantages inherent in conventional hardwiring processes are generally obviated through the employment of a wiring system known particularly in the industrial lighting field by the mark RELOC which is a trademark of Lithonia Lighting, Inc., a Division of National Service Industries, Inc. of Atlanta, Ga. The RELOC system product by Lithonia Lighting is particularly useful in the installation of both high bay and low bay lighting systems wherein HID fixtures are employed. The commercially successful RELOC system facilitates the construction of installations such as the lighting systems just mentioned which employ HID fixtures. However, any installation, whether HID, incandescent or fluorescent, can utilize the RELOC system to advantage with labor savings of approximately 75% and total job cost reductions of approximately 25%. Further, use of the RELOC system involves a minimum number of inventoried components which can be manufactured with high quality control to meet or exceed the requirements of UL, the National Electrical Code and CSA. The process of installation of the RELOC system requires only a single pass along each branch circuit or row of fixtures in order to install the system and to hang fixtures. The time required for a RELOC installation is therefore a fraction of the time necessary for conventional hardwiring systems. Industrial HID fixtures can be installed in a typical warehouse lighting application with substantial labor savings, job labor content using hardwiring processes typically being the highest percentage of a total job cost. Additionally, the RELOC system can be used for temporary lighting during facility construction and again for permanent lighting. Fixtures can be easily relocated and circuitry changed due to layout revision, expansion or for other reasons through the use of the RELOC wiring system. The RELOC wiring system has been recently improved by the incorporation of a circuit selector associated with lighting fixtures which allows the fixtures to be connected to a particular circuit of a plurality of circuits which are contained within cable which is plugged together through the use of female connector heads and male connector heads located at opposite ends of discrete lengths of cable. These discrete lengths of cable are plugged together to form a desired branch circuit length. The circuit selection device is described in detail in U.S. patent application Ser. No. 08/198,840, filed Feb. 18, 1994, by the present inventors, the disclosure thereof being incorporated hereinto by reference. The RELOC system and the several components forming the system will be briefly described hereinafter with reference to FIGS. 1 through 4 of the present application which clearly sets out the prior art as embodied in the RELOC system and over which the present intends improvement, this improvement primarily relating to a dual-port female connector head useful for branch circuit extension and for fixture tapping into the relocatable wiring system which constitutes an improved system due to the inclusion of the presently improved female connector head. The female connector head of the invention has two connection ports disposed in an angular relationship to each other which is out of plane with the plane of the body of the connector head, both ports being capable of use either as a tapping port or as a branch circuit port. The female connector head of the invention provides a compact, relatively inexpensive and more easily manufactured structure when compared to the structures of the prior art. Manufacture of the present female connector head can be accomplished using fewer discrete parts with a resulting savings of labor and material, the female connector head of the invention further displaying greater operational flexibility. These and other advantages are achieved due to the particular structure of the female connector head which constitutes an improvement in the art over prior dual port industrial cable connectors. The present female connector head also improves the relocatable wiring system itself within which the female connector head displays its greatest utility.

SUMMARY OF THE INVENTION

The invention provides an improved dual port female connector head such as is connected to one end of a length of electrical cable forming a unit portion of a relocatable wiring system such as that system known commercially as the RELOC system, a trademark of Lithonia Lighting, Inc., a Division of National Service Industries, Inc. of Atlanta, Ga. The cable has one end thereof joined to the female connector head of the invention and has a conventional male connector head joined to the opposite end of the cable, this combination of the female connector head, the male connector head and the length of cable constituting a repetitive unit in a relocatable wiring system, the male connector head of a given cable unit being pluggable into a branch circuit port of the female connector head of an adjacent cable unit. A fixture tap port also formed on the female connector head receives a male circuit selector plug or other circuit plug which is electrically connected to a lighting fixture or other electrical load. The lighting fixture thus taps into the wiring system and, in the event of the placement of more than one circuit within the cable, the fixture is plugged into the appropriate circuit extending throughout the series of electrically connected cable units. In the present female connector head, the two ports are interchangeable in function, that is, the port normally usable as a branch circuit port for receiving a male connector head from an adjacent cable unit can be used as a tapping port for a lighting fixture or the like. Similarly, the tapping port normally employed to allow the tapping of a lighting fixture or the like into the relocatable wiring system can be used as a branch circuit port and especially for connection to parallel runs of branch circuitry or for connection to a circuit having at least a few fixtures and which is disposed in a relationship to a particular branch circuit which is not aligned with the branch circuit or parallel to the branch circuit. The ability to utilize the two ports of the female connector head either as a tapping port or as a branch circuit port provides substantial flexibility in system design and in operation.

The female connector head of the invention locates the two connection ports in an angular relationship, typically 90°, which is out of plane with the body of the connector head. This spatial relationship of the ports allows the connector head to be more compact and provides a much lower profile when compared to dual-port connectors of the prior art. The angled relationship of the two ports also allows a reduction of component elements necessary for fabrication of the connector head. In a three circuit relocatable wiring system arrangement, the structure of the present connector head reduces the requirement for discrete terminal elements from ten to five when compared with prior dual-port devices and further reduces the components necessary for fabrication by eliminating the need for a separate jumper wire extending between ports of prior dual-port devices. Still further, the structure of the present female connector head obviates the need for five discrete terminal elements in one port which are of a different design from the terminal elements in a second port when considering that structure necessary to operation of prior dual-port connector devices. Given the reduction in the number of structural elements which need to be assembled to form the present female connector head, it is seen that the present structure can be more readily assembled due to the reduced number of parts necessary for fabrication.

A particular structural element of the invention which also is a factor in the reduction of parts necessary for fabrication and the time necessary for assembly of these parts is a dual-socket terminal structure wherein the sockets of the discrete terminal structure are formed in an angular relationship to each other which is essentially identical to the angular relationship between the ports of the female connector head. In a preferred embodiment of the invention, the angle formed by the longitudinal axes of the socket portions of the improved terminal of the invention is 90° or within a few degrees of a right angle. Only five terminal structures are necessary for fabrication of the present female connector head which is a part of a three-circuit wiring system, four of these terminal structures being identical but the fifth terminal structure being of slightly greater overall length and having a keying element which only allows assembly of the slightly longer terminal element into the ground location of the connector head as will be described hereinafter.

The present female connector head comprises an enclosed housing formed of a base and cover which is preferably formed of a polymeric material or "plastic" having appropriate physical properties as will be described hereinafter, the base and cover being molded to include retaining structures which act to prevent dislodgment or substantial displacement of the terminal elements and circuit neutral and ground wires respectively connected thereto due to stresses exerted from externally of the housing. Certain of the retaining structures act to retain the terminal elements and associated wires during assembly. Channels formed in the base of the housing have angled walls which facilitate mounting of the electrical terminal elements into the channels during assembly. The base and cover are configured with snap-fitting structure which facilitates connection of the base and cover together, the snap-fitting structure being disposed in advantageous locations such that pressure exerted centrally of the housing formed by the base and cover does not act to decouple the snap fitting structure and thus cause inadvertent opening of the housing to expose electrically conducting structure disposed within the housing.

Accordingly, it is a primary object of the invention to provide an improved female connector head for relocatable wiring systems.

It is another object of the invention to provide a relocatable wiring system improved by the provision of a female connector head having ports being interchangeable in use with either of the ports being useful as a tapping port or as a branch circuit port.

Yet another object of the invention is to provide a female connector head useful within the environment of a relocatable wiring system and having at least two connection ports disposed in an angular relationship to each other which is out of plane with the body of the connector head, the angular relationship of the connector head allowing use of discrete and unitary electrical terminal elements in both ports by a configuration of the terminal elements in essentially the same angular relationship as the angular relationship between the two ports of the connector head.

A further object of the invention is to provide a female connector head which is particularly useful within the environment of a relocatable wiring system and which requires fewer parts and manufacturing steps for assembly, the connector head exhibiting a low profile and pleasing appearance and being relatively inexpensive and volumetrically efficient while allowing substantially increased wiring system design flexibility and further exhibiting substantial operational flexibility.

A still further object of the invention is to provide a housing comprising the female connector head of the invention which can be molded to include integral components which hold terminal elements and insulated wires connected thereto in an appropriate location during assembly and which further comprises structure molded with the housing which prevents or reduces the displacement of the terminal elements and associated wiring due to externally imposed forces capable of dislocating said terminals and associated wiring in the absence of the retaining structure of the invention.

Further objects and advantages of the invention will become more readily apparent in light of the following detailed description of the preferred embodiments.

BRIEF DESCRIPTION OF THE DRAWINGS

FIG. 1 is an elevational view of a prior art relocatable wiring system utilizing a dual-port female connector device upon which the present invention intends improvement;

FIG. 2 is an elevational view of a detailed portion of FIG. 1 illustrating a prior art dual port female connector device;

FIG. 3 is a plan view of a prior art dual-port female connector device having a covering portion removed for illustration of the wiring arrangement within the prior art device;

FIG. 4 is a top elevational view of a particular prior art wiring arrangement utilized for either ground, neutral or hot leg portions of the prior art dual-port female connector device of FIG. 3 and illustrating structural components which are eliminated by the improved structure of the invention;

FIG. 9 is a perspective view of the improved female connector head of the invention;

FIG. 11A is a plan view of a plurality of electrical terminal elements in various assembly stages;

FIG. 11B is a side elevational view of an electrical terminal element of the invention prior to crimping of the terminal element to a conductor wire and prior to bending of one socket portion of the terminal element to a 90° angle relative to the other socket portion of the terminal element;

FIG. 11C is a side elevational view of the terminal element of FIGS. 11A and 11B shown crimped to an insulated electrical circuit conductor and formed into an angled socket configuration as is employed in the improved female connector head of the invention;

FIG. 12A is a plan view similar to FIG. 11A but illustrating a terminal element useful only as a ground terminal within the improved female connector head of the invention;

FIG. 12B is a side elevational view similar to FIG. 11B and illustrating the ground terminal element of the invention;

FIG. 12C is a side elevational view similar to FIG. 11C for illustrating the ground terminal element of the invention crimped to a ground circuit conductor and configured with socket portions thereof disposed in angular relationship to each other as when assembled in the improved female connector head of the invention;

FIG. 13 is a perspective view of an electrical terminal element of the invention such as is shown in FIG. 11C;

FIG. 14 is a plan view of the improved female connector head of the invention having the cover thereof removed for ease of illustration of the arrangement of ground, neutral and hot leg circuit elements disposed within the interior of the improved female connector head of the invention;

FIG. 21 is a plan view of the interior of the cover of the improved female connector head of the invention;

FIG. 22 is a rear elevational view of the cover of FIG. 21;

FIG. 23 is a plan view of the exterior of the cover of FIG. 21;

FIG. 24 is a front elevational view of the cover of FIG. 23;

FIG. 25 is a side elevational view of the cover of FIG. 23; and,

FIGS. 26A and 26B are detailed elevational views illustrating the disassembly of the base and cover from an assembled configuration by disengagement of cooperation snap-fitting elements formed on the base and cover.

DESCRIPTION OF THE PREFERRED EMBODIMENTS

Figure 5:
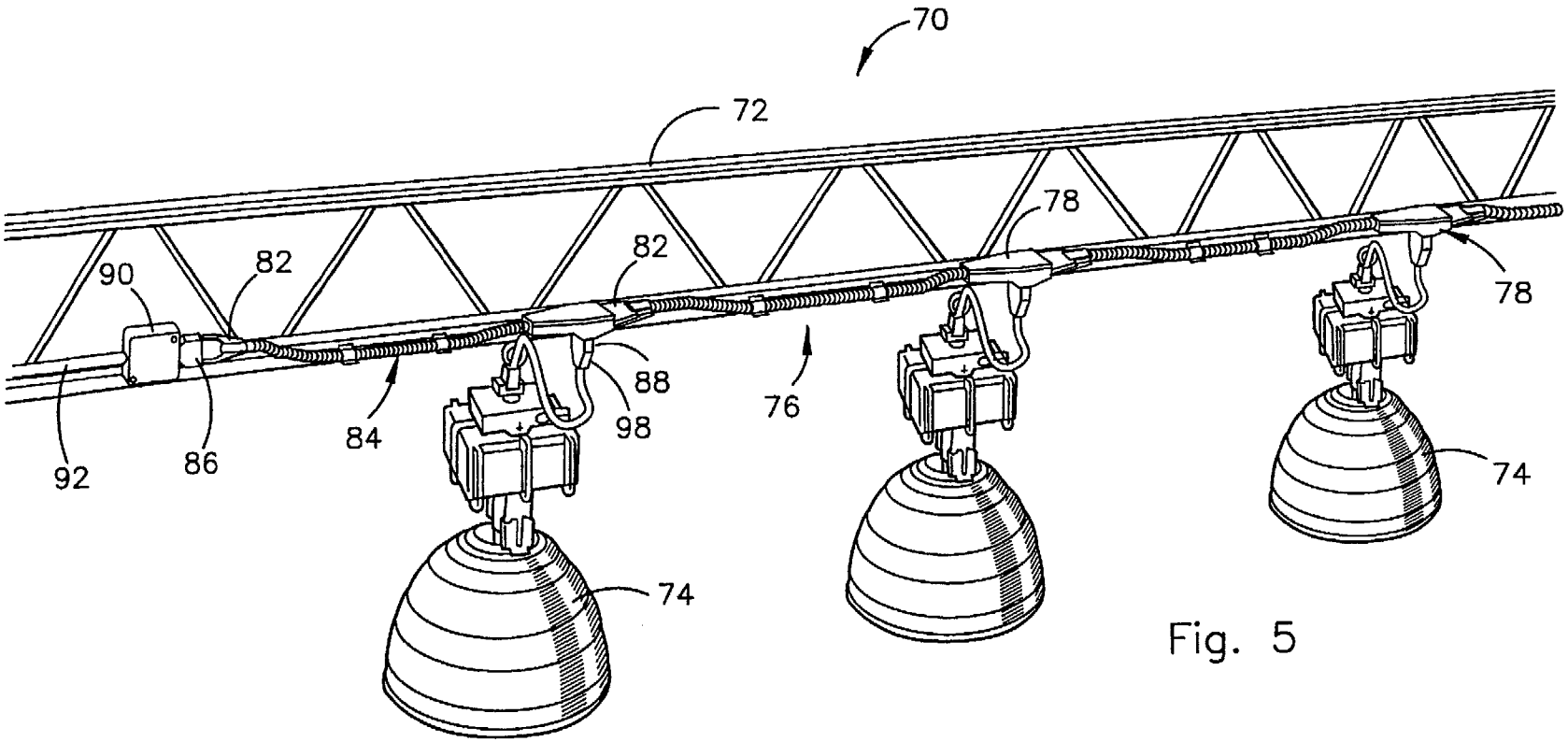
FIG. 5 is a perspective view of a relocatable wiring system improved by the female connector head of the invention.

Referring first to FIGS. 1 through 4, a prior art industrial lighting system such as is improved by the present invention is seen generally at 10 and is mounted to support 12 which functions as the primary support for a row or branch circuit of a system of HID lighting fixtures 14. The system 10 is best seen in FIGS. 1 and 2 to illustrate the structure and function of a relocatable wiring system 16 comprised of a circuit distributor 17, an industrial cable 2-port assembly 18 and a circuit selector assembly 20 which is electrically connected to one of the lighting fixtures 14 by means of a flexible cord 22, the cord 22 being electrically insulated. The cord 22 has a plurality of insulated conductors 24 (not shown in FIGS. 1 and 2) carried within the cord. The circuit selector assembly 20 can conveniently take the form of that apparatus disclosed in U.S. patent application Ser. No. 08/198,840, filed Feb. 18, 1994, by the inventors of the present invention. The relocatable wiring system 16 is also described generally in the aforesaid patent application. The installation comprising the industrial lighting system 10 of FIGS. 1 and 2 can be of the high bay or low bay type and can utilize lighting fixtures other than high intensity discharge fixtures. Further, the electrical loads in such a system could be lighting fixtures such as incandescent or fluorescent fixtures. Electrical loads other than lighting fixtures can also be employed with the relocatable wiring system 16. For purposes of illustration, the invention is readily described within the context of the HID industrial lighting system 10 with emphasis on the relocatable wiring system 16.

As is readily seen in FIGS. 1 and 2 which best illustrate the prior art industrial lighting system 10, the circuit distributor 17 connects by means of a locknut 24 to a junction box 26. Wire leads (not shown) extend from the interior of conduit 28 and through the junction box 26 into the interior of the circuit distributor 17 in a conventional manner. The circuit distributor 17 is provided at its free end, that is, the end opposite that end of the circuit distributor 17 which is connected to the junction box 26, with a connection port 30 having an array of socket contacts (not shown) which are of a conventional nature and which mate with corresponding pin contacts (not shown) located in port 32 of male connector head 34. In essence, the port 30 of the circuit distributor 17 is provided with female socket-like contacts (not shown) which mate with the pin contacts (not shown) in the port 32 of the male connector head 34. These respective female and male contacts are conventional in the art and allow the male connector head 34 to plug into the port 30 of the circuit distributor 17 to initiate the formation of a branch circuit of the relocatable wiring system 16.

The male connector head 34 joins at the end thereof opposite the port 32 to a length of cable 36 which is shown as being much shorter than is the situation in an industrial installation. It is necessary to show the cable 36 as being shorter as a convenience since the actual length of the cable 36 in a typical system 16 is proportionately out of scale to the remaining elements of the system 16. The cable 36 is shown in FIGS. 1 and 2 as being an armoured cable such as is normally employed in installations of this nature due to the high voltages necessary in operating lighting systems such as the industrial lighting system 10. It is to be understood, however, that the cable 36 could be configured other than is shown, such as by being insulated and protected other than is shown in the drawings. As is readily understood, the cable 36 has a ground conductor, a neutral conductor and at least one hot-leg conductor (not shown in FIGS. 1 and 2) which run through the length of the cable 36 and which are respectively connected through the pin and socket contacts located throughout the system and such as are utilized as aforesaid in the connection of the male connector head 34 to the circuit distributor 17.

At the end of the cable 36 opposite the male connector head 34, one of the industrial cable 2-port assemblies 18 is joined to the cable 36. The combination of the cable 36 with one of the male connector heads 34 at one end and one of the industrial cable 2-port assemblies 18 at the other end constitutes the basic "building block" of the relocatable wiring system 16 and is thus referred to as a cable unit 38. Multiples of the cable units 38 are joined together to form a branch circuit for operational mounting of the lighting fixtures 14. As is readily seen, the male connector head 34 of a given cable unit 38 plugs into a branch circuit port 40 of the adjacent industrial cable 2-port assembly 18 so that multiples of the cable units 38 can be plugged together to form a heavy-duty "extension cord" of a desired length. A branch circuit of the relocatable wiring system 16 is thus formed of a multiple of the cable units 38, the branch circuit extending along a row along which the lighting fixtures 14 are to be mounted.

The industrial cable 2-port assembly 18 is provided with a second port which is generally referred to as a tapping port 42. The tapping port 42 and the branch circuit port 40 are both provided with female socket contacts which are best seen in FIG. 4 which illustrates a prior art wiring arrangement, multiples of which are seen in the prior art structure of FIG. 3. The female socket contacts seen best in FIG. 4 are differently constructed contacts depending upon the port within which the contacts are employed. In the branch circuit port 40, a double-crimp socket terminal 44 as seen in FIG. 4 is provided for each of the circuit wires 48, 50 and 52. A ground wire 46 and a neutral wire 54 are also connected to terminals 44. The circuit wires 48, 50 and 52 are hot-leg wires, these wires extending from the interior of the cable 36 as best seen in prior art FIG. 3 to connect one each to one of the double-crimp socket terminals 44 (not visible in FIG. 3) located within one of the terminal housings 56. A jumper wire 58 is also crimped to the double crimp socket terminal 44 as seen in FIG. 4 and extends to the tapping port 42 within the interior of the cable 2-port assembly 18, as best seen in prior art FIG. 3, to be crimped to a single-crimp socket terminal 60, each of the jumper wires 58 terminating in the tapping port 42 with a single-crimp socket terminal 60. A total of five of the socket terminals 60 are disposed in the tapping port 42 since the system shown in prior art FIGS. 1 through 4 is a three-circuit system wherein three hot circuits are employed along with a ground leg and a neutral leg.

The double crimp socket terminals 44 are manufactured by Molex, Inc. and are conventional female socket terminals which are capable of receiving one of the circuit wires 46 through 54 at one crimping location and one of the jumper wires 58 in a second crimping location to thereby be crimped to and hold one of said circuit wires and one of said jumper wires. In practice, the circuit wires 46 through 54 are typically 12 gauge electrically conductive wiring specified as 12 AWG wire. The jumper wires 58 are normally 16 gauge electrically conductive wire and are referred to in the art as 16 AWG wire. Each jumper wire 58 crimps to a corresponding socket terminal 60 which respectively acts as ground, neutral and hot legs. The single crimp socket terminals 60 are also manufactured by Molex, Inc. and are of standard design and being of the type having dual crimping capability whereby the terminal 60 is crimped at one location to exposed wire and at a second location to insulation covering the wire along major portions thereof. The double crimp socket terminal 44 has similar crimping capability but is configured to receive and crimp as many as two separate wires.

The tapping port 42 of the industrial cable 2-port assembly 18 receives pin contacts (not shown) into at least certain of the socket terminals 60 disposed in the tapping port 42 so that the circuit selector assembly 20 is "plugged" into the tapping port 42 of the 2-port assembly 18. The circuit selector assembly 20 is secured to the industrial cable 2-port assembly 18 as is described in U.S. patent application Ser. No. 08/198,840 of Feb. 18, 1994. As is described in said patent application, the circuit selector assembly 20 functions to connect the lighting fixture 14 joined to the assembly 20 by the flexible electrical cord 22 to the appropriate circuit carried by the relocatable wiring system 16.

Referring again to prior art FIG. 3, it is to be seen that the branch circuit port 40 and the tapping port 42 essentially lie in a plane defined by the body of the 2-port assembly 18 and are essentially disposed 90° from each other within this plane. This geometrical relationship between the branch circuit 40 and the tapping port 42 requires the use of five separate double-crimp socket terminals 44 within the branch circuit port 40 and five separate single-crimp socket terminals 60 within the tapping port 42. Further, five separate jumper wires 58 are required to interconnect the five socket terminals 44 with the five socket terminals 60 as has been described. It can further be seen with reference to prior art FIGS. 1 through 3 that the industrial cable 2-port assembly 18 is formed of a housing 62 which is of substantial weight due to the fact that it is preferably constructed of metal, a base portion 64 of the housing 62 having a cover 66 which is best shown in prior art FIG. 2. The cover 66 connects to the base portion 64 through the use of metal connectors and the like which add additional weight to the housing 62. Since metal is used to form the base portion 64 and the cover 66, the housing 62 is not only heavy but is also expensive. The structure of the housing 62 is inconvenient for forming structure within said housing 62 which could facilitate the disposition of desirable retaining structure within the interior of the housing 62 to prevent dislodgement and/or displacement of the terminals 44 and 60 and the electrical wiring associated with these terminals. While the terminal housings 56 of the branch circuit port 40 and corresponding housings 68 of the tapping port 42 are integrally formed of material other than metal and are thus of lighter weight, it is still necessary to insert into the respective ports 40 and 42 during manufacture these terminal housings 56 and 68. The housings 56 and 68 must further be handled during assembly to receive one of the socket terminals 44 or 60 as is appropriate. Still further, the jumper wires 58 must be joined to the double-crimp socket terminals 44 along with joining of the appropriate circuit wires 46 through 54 with the appropriate socket terminal 44, it also being necessary to join each of the jumper wires 58 to the appropriate single-crimp socket terminal 60. Fabrication of the industrial cable 2-port assembly 18 is therefore time-consuming due in part to the requirement for assembly of ten separate and discrete terminals of two different kinds and due to the additional need for assembly of these socket terminals 44 and 56 to one each of the jumper wires 58.

The present invention as will now be described improves the relocatable wiring system 16 by providing an improved structure which replaces the industrial cable 2-port assembly 18 of said system 16, the improvements and advantages of the invention being now described with reference to FIGS. 5 through 26, with FIGS. 1 through 4 allowing comparison with the improvements of the invention.

Referring now to FIGS. 5 through 9, an industrial lighting system is seen generally at 70 to form a branch circuit mounted by support 72, the lighting system 70 comprising high intensity discharge lighting fixtures 74. A relocatable wiring system seen generally at 76 is seen to be improved by the substitution into the system 76 of a female connector head 78 which replaces the industrial cable 2-port assembly 18 of the prior art as has been described relative to FIGS. 1 through 4. The relocatable wiring system 76 and the industrial lighting system 70 are substantially identical to the prior art system described in relation to FIGS. 1 through 4. The descriptive matter provided relative to the relocatable wiring system 16 and the industrial lighting system 10 of FIGS. 1 through 4 generally apply to said systems 70 and 76 with the particular exception of the female connector head 78 as will be described in detail hereinafter.

The female connector head 78 is joined to one end of a cable 80 while a male connector head 82 is joined to the opposite end of the cable 80. The cable 80 can be substantially identical in structure and function to the cable 36 referred to relative to FIGS. 1 through 4, the cable 80 carrying interiorly thereof electrical conductors corresponding to ground, neutral and to at least one hot leg. In practice, the cable 80 carries three circuits, one of which is tapped into preferably at each of the female connector heads 78 by one of the lighting fixtures 74 or by another electrical load. The cable 80 and the connector heads 78 and 82 form a basic building block of the relocatable wiring system 76, the combination of the cable and heads 78, 82 being therefore referred to as a cable unit 84. Multiples of the cable units 84 connect to each other to form a branch circuit of the system 76, the length of the branch circuit being the total of the lengths of the cable units 84 comprising said branch circuit.

The relocatable wiring system 76 is comprised of a circuit distributor 86 and a circuit selector assembly 88, the selector assembly 88 being described in detail in U.S. patent application Ser. No. 08/198,840, filed Feb. 18, 1994, the disclosure of which is incorporated hereinto by reference. The relocatable wiring system 76 further includes a plurality of the cable units 84, each cable unit being comprised as aforesaid of the connector head 78 and 82 joined to opposite ends of a length of the cable 80.

The relocatable wiring system 76 of the invention is assembled by connecting the circuit distributor 86 to a junction box 90 in a conventional manner. The junction box 90 receives circuit wiring from conduit 92 which communicates with the interior of the junction box 90. The circuit distributor 86 acts as a transition between hardwiring represented by the conduit 92 and the junction box 90 and the relocatable wiring system 76. Circuit wiring from the conduit 92 is connected to corresponding circuit conductors 94 from the circuit distributor 86 interiorly of the junction box 90, each of the conductors 94 being respectively connected to a female socket terminal (not shown) located in port 96 of the circuit distributor 86. Male pin terminals (not shown) disposed in the male connector head 82 and aligned to be received by the female socket terminals of the circuit distributor 86 allow the male connector head 82 to be plugged into the port 96 of the circuit distributor 86, the male pin terminals and the female socket terminals which cannot be seen in the drawings but which are conventional in the art acting to facilitate connection of the male connector head 82 to the circuit distributor 86. Spring latches (not shown) disposed at the plugging end of the male connector head 82 cooperate with corresponding latch structure (not shown) disposed in proximity to the port 96 of the circuit distributor 86 securely retain the head 82 and distributor 86 in a plugged together relationship. The male pin terminals (not shown) of the male connector head 82 are electrically connected to circuit wiring (not shown) which extends through the male connector head 82 and subsequently through the cable 80 to the female connector head 78, power thus being fed from the circuit distributor through the male connector head 82 and then through the female connector head 78 to the circuit selector assembly 88 and then to the lighting fixture 74.

The circuit selector assembly 88 functions as is described in the aforesaid patent application to allow field selection of a desired hot conductor needed to energize the fixture 74. A selector plug 98 of the circuit selector assembly 88 is provided with male pin terminals (not shown) which are received within tapping port 100 of the female connector head 78, the tapping port 100 having female barrel sockets 102 forming a part of female terminals 104 as will be described hereinafter. The female connector head 78 is also provided with a branch circuit port 106 having female barrel sockets 108 disposed in the port 106 and aligned to receive male pin terminals (not shown) disposed in the male connector head 82 of an adjacent cable unit 84. Accordingly, the female connector head 78 is provided with a branch circuit port 106 which is plugged into by the male connector head 82 of an adjacent cable unit 84 and further is provided with a tapping port 100 which is plugged into by means of the selector plug 98 of the circuit selector assembly 88. The branch circuit port 106 of the female connector head 78 thus allows a branch circuit of the relocatable wiring system 76 to be continued for a predetermined length, the tapping port 100 allowing one of the lighting fixtures 74 to tap into the relocatable wiring system 76 at each of the female connector heads 78. The female connector head 78 of the invention, however, is configured such that the function of the respective ports 100 and 106 are interchangeable, that is, the tapping port 100 can receive the male connector head 82 of another cable unit 84 and the branch circuit port 106 can be used as a tapping port to receive the selector plug 98 of one of the circuit selector assemblies 88. A side run of a few of the fixtures 74, such a side run not being shown in the drawings, can thus be connected to a main branch circuit row of fixtures by plugging the male connector head 82 of one of the cable units 84 comprising such a side run into the tapping port 100 so that the side run of the fixtures 74 is joined electrically and mechanically to the branch circuit of the system 76 at a desired location therealong where one of the female connector heads 78 is located. The female connector head 78 of the invention therefore exhibits increased versatility and flexibility in function when compared to prior art devices comprising prior relocatable wiring systems.

Figures 6, 7, 8:
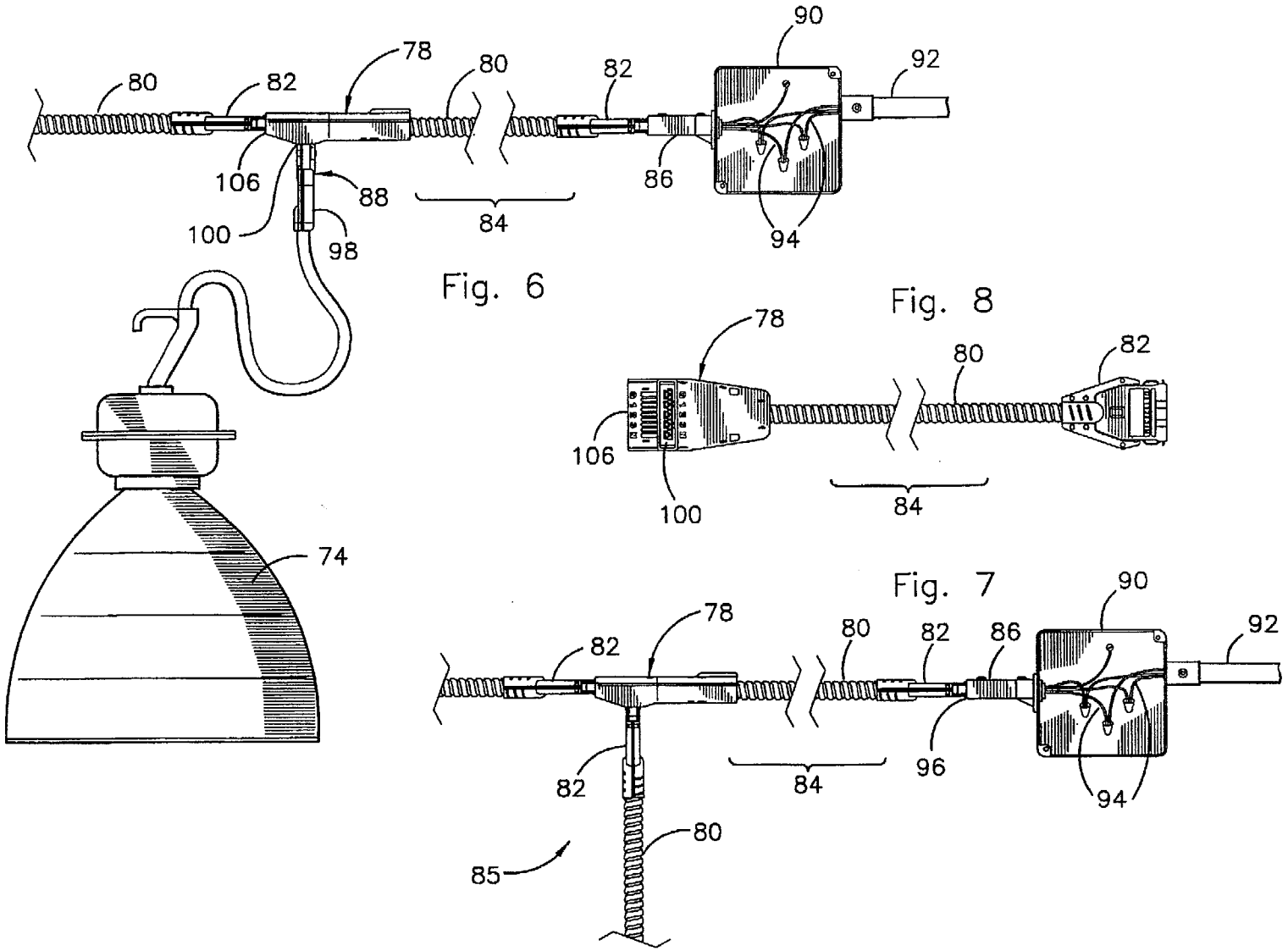
FIG. 6 is a detailed elevational view of portions of the system of FIG. 5.
FIG. 7 is a side elevational view of portions of a relocatable wiring system particularly illustrating a branch circuit and extension circuit according to the invention.
FIG. 8 is a plan view of the improved female connector head of the invention in combination with a circuit-bearing protective sheath forming a cable joined at one end to the improved female connector head of the invention and at the opposite end to a male connector head.

FIG. 7 shows use of the cable unit 84 to form branch extension 85, a head 78 receiving one each of the male heads 82 into the ports 100 and 106. The low profile and clean appearance of the connector head 78 in an aligned relationship of the cable units 84 is also seen in FIG. 7. FIG. 8 illustrates one of the cable units 84 including the cable 80 having the male connector head 82 joined at one end to the cable 80 and having a female connector head 78 joined to the other end of the cable 80.

Figure 15A:
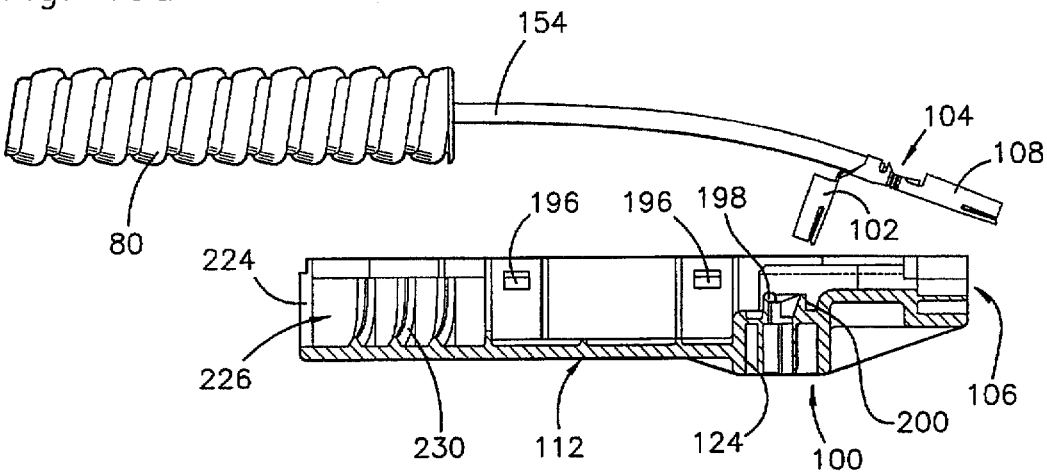
FIGS. 15A, 15B and 15C are side elevational views illustrating the assembly of the female terminal element of FIG. 11A and circuit conductor crimped thereto into the base of the improved female connector head of the invention.
Figure 15B:
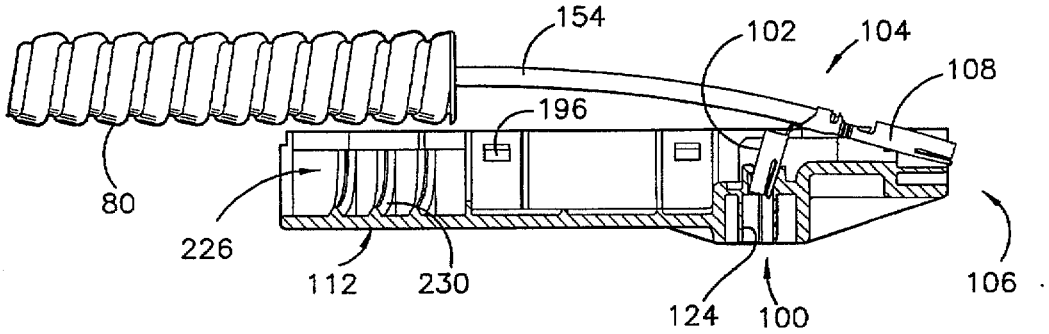
Figure 15C:
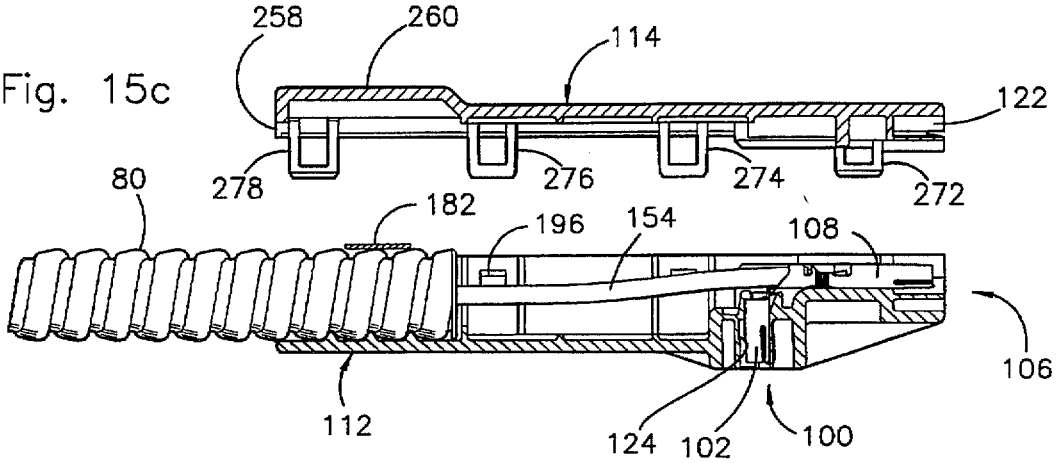
Figure 20:
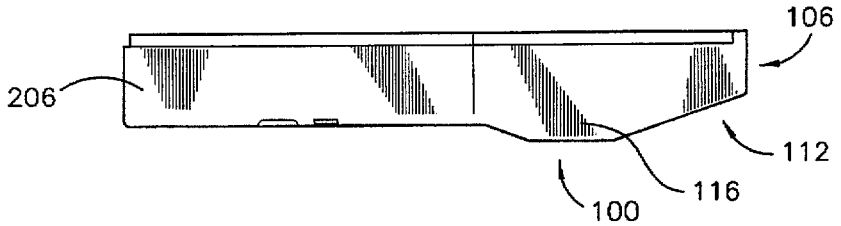
FIG. 20 is a side elevational view of the base.
Figure 16:
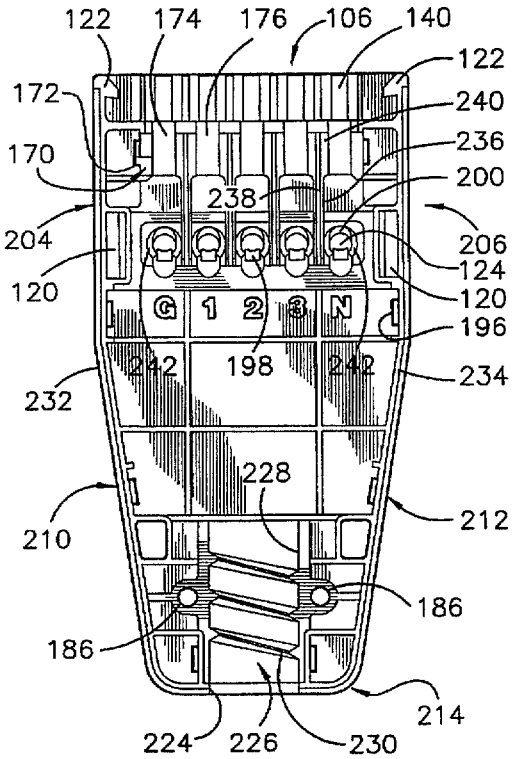
FIG. 16 is a plan view of the interior of the base of the improved female connector head of the invention.
Figure 18:
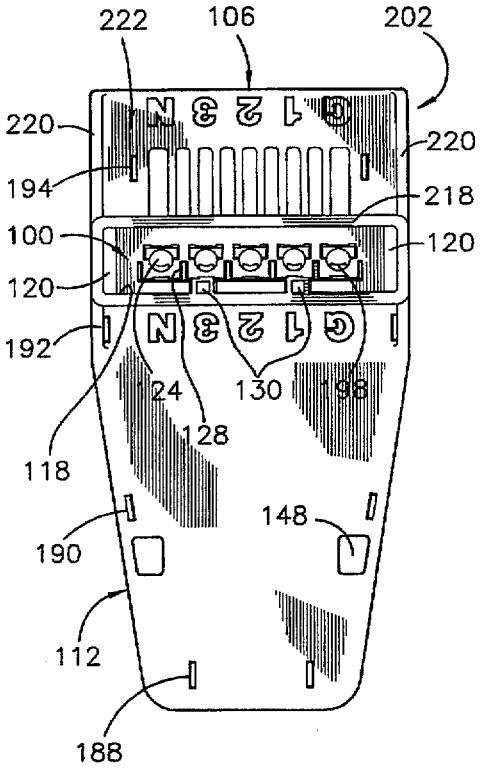
FIG. 18 is a plan view of the exterior of the improved female connector head of the invention.

FIG. 9 provides a perspective view of the female connector head 78 and particularly illustrates housing 110 of the head 78 formed of the assembly of a base 112 and a cover 114, the base 112 and the cover 114 being further illustrated in FIGS. 16 through 20 and 21 through 25 respectively. The structure and function of the housing 110 can also be appreciated from a consideration of FIGS. 10, 14 and 15A–C inter alia. FIG. 9 illustrates the housing 110 in an assembled relationship of the base 112 and the cover 114. The base 112 is seen to have the tapping port 100 formed therein, the port 100 essentially being formed in a raised boss portion 116 of the base 112, the boss portion 116 having a rectangular recess 118 formed therein, the rectangular recess 118 having at either side a spring lock engaging tab 120 as is best seen in FIGS. 16 and 18. The tabs 120 each receive a snap-fitting hook element of a spring lock formed on opposite sides of aligned male pin terminals on both the male connector head 82 and on the selector plug 98 for locking of the head 82 and of the plug 98 into respective ports 106 and 100. The spring locking mechanisms referred to as being located on the male connector head 82 and on the selector plug 98 are not visible in the drawings which are a part of this patent application. However, the spring locking mechanisms referred to can be readily seen in the apparatus described in U.S. patent application Ser. No. 08/198,840, filed Feb. 18, 1994, by the same inventors, this structure being located on the selector plug 98 which corresponds to the structure of the aforesaid patent application. This spring locking structure of the selector plug 98 is essentially identical to the spring locking structure to be found on the male connector head 82.

The branch circuit port 106 as seen in FIG. 9 is seen to be provided with a spring lock engaging tab 122 on one end of the port 106, two of the tabs 122 being visible in FIGS. 16 and 21. In a fashion similar to that described relative to the tapping port 100, the spring lock engaging tabs 122 disposed one each on either side of the port 106 cooperate with spring lock mechanisms on the selector plug 98 and on the male connector head 82 to snap-fit said head 82 and said selector plug 98 to one or the other of the ports 100 and 106 of the female connector head 78.

The rectangular recess 118 formed in the boss portion 116 of the base 112 is seen to have five terminal channels 124 formed in the floor of the recess 118, the channels 124 extending into the interior of the housing 110. Each of the terminal channels 124 is surmounted exteriorly of the housing 110 and within the recess 118 by an arcuate wall element 126 on one side of the channel 124 and by a U-shaped wall element 128 which is located in opposing relationship to the arcuate wall element 126. The wall elements 126 and 128 act to separate the female barrel sockets 102 from each other, one each of said female barrel sockets 102 extending from interiorly of the housing 110 through one of the terminal channels 124 and into that space defined by the opposing wall elements 126 and 128. The wall elements 126 and 128 act to electrically insulate the barrel sockets 102 from each other by preventing contact therebetween. Keying tabs 130 are located adjacent to at least two of the U-shaped wall elements 128 in a preselected pattern which allows insertion of the selector plug 98 (or the male connector head 82) into the tapping port 100.

The branch circuit port 106 is also recessed into the housing 110 with a portion of rectangular recess 132 being formed in the base 112 and a mating portion of said recess 132 being formed in the cover 114. The recess 132 has the spring lock engaging tabs 122 located on either side thereof as referred to hereinabove. Further, the recess 132 has terminal channels 134 formed in the floor of the recess 132, approximately one-half of each of the terminal channels 134 being formed by an arcuate recess 136 formed in the base 112 with the other half of each terminal channel 134 being formed by an arcuate recess formed in the cover 114. The terminal channels 134 extend into the interior of the housing 110 to communicate the exterior of said housing 110 with the interior thereof. Interiorly of the rectangular recess 132, U-shaped wall elements 140 are formed on the base 112 in surmounting relation to the terminal channels 134. Arcuate wall elements 142 are formed in surmounting relation to the channels 154 on the cover 114 (FIG. 24) in oppositely disposed relation to the U-shaped walls elements 140. The wall elements 140 and 142 act in a manner similar to the wall elements 126 and 128 of the port 100 to separate female barrel sockets 108 from each other, the female barrel sockets 108 being essentially the opposite end of the female terminals 104. As will be described in greater detail hereinafter, the female barrel sockets 102 of the tapping port 100 and the female barrel sockets 108 of the branch circuit port 106 are effectively opposite ends of the female terminals 104. However, the longitudinal axes of said barrel sockets 102 and 108 are arranged at an angle of approximately 90° to each other, thereby forming a 90° bent female terminal 104. Keying tabs 146 are formed within the recess 132 and adjacent at least two of the U-shaped wall elements 140, the keying tabs 146 being identical in pattern to the keying tabs 130 of the tapping port 100, thereby allowing a properly configured male connector head 82 or a properly configured selector plug 98 to be insertible into either of the ports 100 or 106 for structure of the same voltage capability.

The tapping port 100 as further seen in FIG. 9 is geometrically related to the branch circuit port 106 in an angular relationship. As shown in FIG. 9 and in the drawings, this angular relationship is essentially 90° although the relationship could vary by a few degrees or even by a greater amount in the event that the exigencies of a particular situation required or allowed an angle between the ports 100 and 106 to be other than a nominal 90°. To further define this angular relationship, it is to be seen that the longitudinal axes of the terminal channels 124 in the tapping port 100 are located at 90° angles to the terminal channels 134 in the branch circuit port 106. Described differently, the longitudinal axes of the female barrel sockets 102 located in the tapping port 100 are disposed at right angles to the longitudinal axes of the female barrel sockets 108 disposed in the branch circuit port 106. In essence, the tapping port 100 is disposed at a 90° angle to the branch circuit port 106, these ports being "out of plane" relative to each other. Considering the branch circuit port 106 to be effectively "in the plane of" the female connector head 78, the tapping port 100 would then be disposed at an angle of 90° to the "plane" of the female connector head within which plane the branch circuit port 106 is disposed. This geometrical relationship between the tapping port 100 and the branch circuit port 106 provides a number of substantial advantages. In particular, the female connector head 78 presents a low profile as is noted in FIGS. 5 and 7 inter alia when in an assembled relationship with other components of the relocatable wiring system 76. More importantly, the geometrical relationship of the ports 100 and 106 allows use of a single 90° bent female terminal such as the terminal 104 for each circuit conductor socket location of the ports 100 and 106. A total of four of the female terminals 104 would then be provided for the four terminal positions of both of the ports 100 and 106. As will be described hereinafter, a slightly different female terminal is used for the ground terminal in order to assure that the differently sized ground terminal is locatable only in the ground terminal position of the ports 100 and 106. The geometric relationship of the ports 100 and 106 further simplifies wiring within the interior of the female connector head 78 and particularly allows the elimination of jumper wires between dissimilar female terminals as is required in the prior art devices over which the present female connector head 78 intends improvement. These advantages and that structure facilitating said advantages will be described in more detail hereinafter.

Continuing in reference to FIG. 9, it is to be seen that the cable 80 joins to that end of the head 78 opposite the branch circuit port 106, the cable 80 connecting to the head 78 in a manner which will be described in greater detail hereinafter. Also seen in FIG. 9 are channels 148 which extend through the housing 110 on either side thereof at the end of the head 78 at which the cable 80 connects to said head. The channels 148 extend through the base 112 and the cover 114 on either side of the head 78 to allow wire ties or Nylon ties (not shown) to be inserted through said channels 148 so that the head 78 can be connected to supporting structure such as the support 72.

Figure 10:
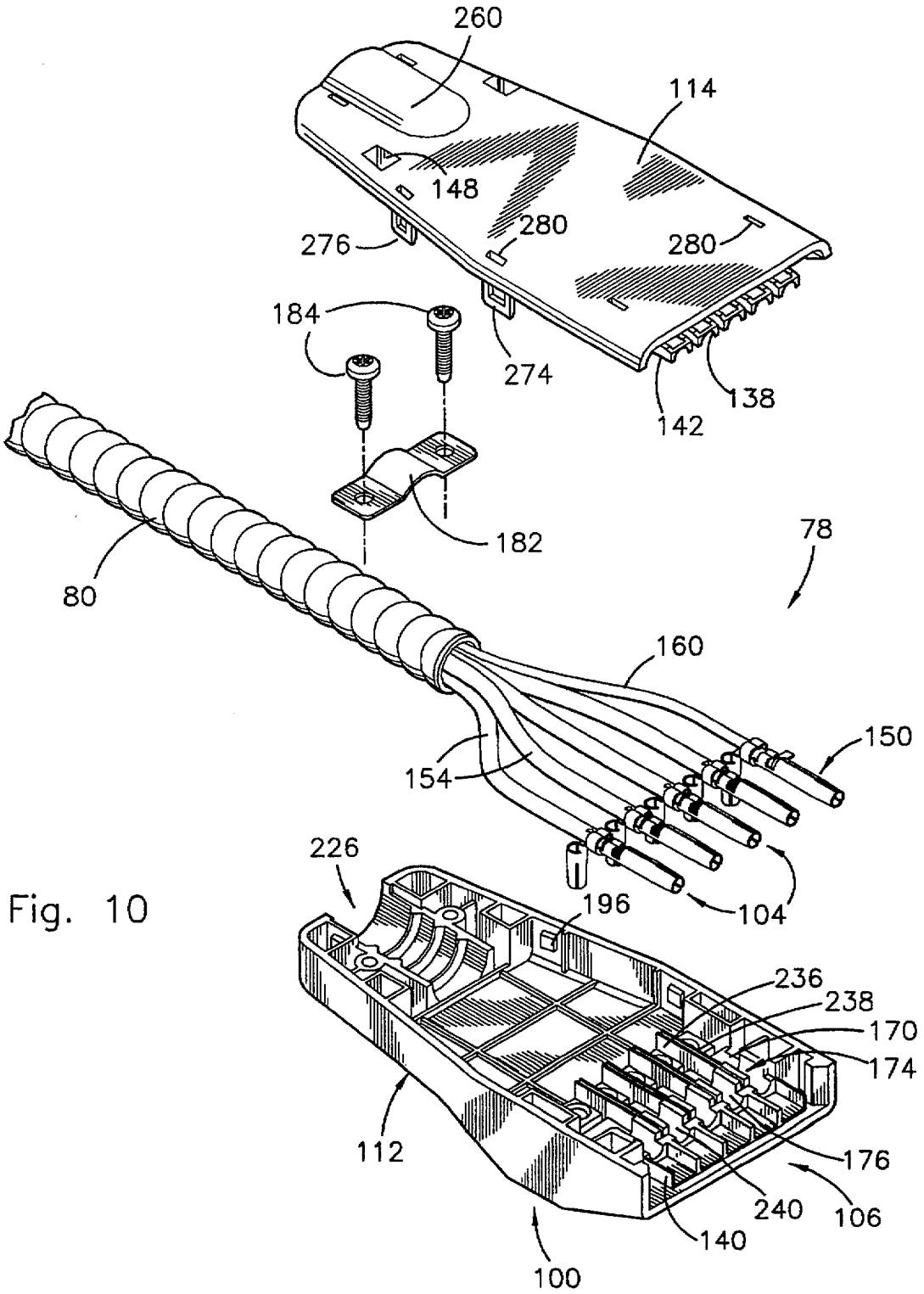
FIG. 10 is an exploded view of the improved female connector head of the invention.

Referring now to FIG. 10, the female connector head 78 of the invention is seen in an exploded view which is provided primarily for assistance in visualizing various features of the head 78 which cannot be readily seen in the elevational and plan views of the other drawings. It is seen that the base 112 and the cover 114 shown spaced from each other in FIG. 10 come together to enclose electrical terminals and circuit wiring within the interior of the head 78.

Referring now particularly to FIGS. 11A through 11C; FIGS. 12A through 12C and FIG. 13, assembly of the female terminal 104 is seen in FIGS. 11A, 11B and 11C. A ground female terminal 150 is seen in FIGS. 12A, 12B and 12C during assembly thereof. The female terminal 104 is seen in a finished assembly condition in FIG. 13. Assembly of the female terminal 104 and the ground female terminal 150 is essentially identical and will thus be described relative to FIGS. 11A, 11B and 11C which illustrate assembly of the female terminal 104. The female terminal 104 is used for the neutral leg and for the hot legs in the female connector head 78. As is seen in FIG. 11A, the terminals 104 are seen to be fed on a carrier strip 152 on a reel (not shown). In the press, the female barrel socket 102 is disengaged from the portion of the carrier strip 152 to which it is mounted and the barrel socket 102 is bent 90° out of plane with the barrel socket 108. A neutral or a hot leg insulated conductor wire 154 which has been stripped at the end thereof is then placed on the terminal 104 with the uninsulated end portion of the wire 154 being located between opposed crimping tabs 156, a pair of insulation crimping tabs 158 being disposed immediately behind the crimping tabs 156 and toward the end of the terminal 104 nearmost the socket 102 which is bent out of plane relative to the wire 154 and, as aforesaid, with the socket 108. The respective pairs of crimping tabs 156 and 158 are then crimped downwardly such that the tabs 156 positively engage the exposed conductive end portion of the wire 154 while the insulation crimping tabs 158 positively engage and crimp that portion of the insulation of the insulated wire 154 immediately behind the stripped and exposed end portion of the wire 154. The resulting assembly is seen in elevation in FIG. 11C which illustrates the female terminal 104. The female terminal 104 is also seen in FIG. 13 and provides a better view of the crimping of the tabs 156 to engage the exposed conductive end portion of the wire 154. The insulation crimping tabs 158 are also seen to engage the insulation of the insulated wire 154 and to sufficiently deform the insulation to provide positive engagement therewith.

Referring now to FIGS. 12A, 12B and 12C, assembly of the ground female terminal 150 with a bare ground wire 160 can be seen. The ground female terminal 150 is essentially identical to the female terminal 104 with several important exceptions. A first difference is that the barrel sockets 162 and 164 of the terminal 150 are 5/1000 inch longer than the corresponding sockets 102 and 108 of the female terminal 104. This additional length allows the ground female terminal 150 to mate with a male pin terminal (not shown) in either of the ports 100 or 106 either at the same time or before male pin terminals (not shown) mate with the sockets 102 or 108 of the female terminals 104 respectively located in the ports 100 and 106. Since it is important that the ground female terminal 150 mates with the corresponding ground male pin terminal located either on one of the male connector heads 82 or one of the selector plugs 98, it is necessary to assure that only the slightly larger ground female terminal 150 can fit into that location within the female connector head 78 which is intended for the ground terminal. Accordingly, a location tab 166 is disposed to the side of cutouts 168 formed in sides of the terminal 150. The location tab 166 fits into a notch 170 formed in an interior wall 172 which wall 172 partially defines an interior housing 174 molded in the base 112 for receiving the ground female terminal 150. Each of the neutral and hot legs comprising the female terminals 104 and insulated wires 154 are provided with an interior housing 176 molded into the interior of the base 112, these interior housings 174 and 176 being further defined and referred to hereinafter. Due to the provision of the location tab 166 on the ground female terminal 150, the ground terminal will only fit in the interior housing 174 since the location tab 166 must fit into the notch 170. Any attempt to position one of the ground female terminals 150 in one of the housings 176 would be defeated since the location tab 166 on the terminal 150 would not fit into any one of the interior housings 176. The crimping tabs 178 and the crimping tabs 180 are respectively crimped to engage the exposed end portion of the ground wire 160.

The terminals 104 and 150 could alternatively be formed as "male" terminals by using pin contacts (not shown) in place of the "female" barrel sockets 102, 108 and 162, 164. The "female" connection capability would then be formed in the head 82, for example.

Referring now to FIG. 14, it is to be seen that the ground female terminal 150 crimped to the bare ground wire 160 is fitted into the base 112 of the female connector head 178, the barrel socket 162 of the terminal 150 extending into the branch circuit port 106 while the barrel socket 164 of the ground female terminal 150 extends into the lowermost terminal channel 124 formed in the tapping port 100 as viewed in FIG. 14. It is also noted in FIG. 14 that the barrel socket 162 of the terminal 150 is slightly longer than the corresponding barrel sockets 108 of the several female terminals 104 which extend into the branch circuit port 106. The female barrel sockets 102 of the several female terminals 104 which extend into the tapping port 100 are received one each into the remaining terminal channels 124. The sockets 102 and 108 of the female terminals 104 and the sockets 162 and 164 of the terminal 150 are thus positioned to receive male pin contacts (not shown) from either one of the male connector heads 82 or one of the selector plugs 98 as aforesaid and as can be readily seen from a consideration of FIG. 14. It is to be understood that pin terminals (not shown) could be used in one or both of the ports 100 and 106 with corresponding barrel sockets being then disposed in the head 82, for example.

A comparison of the interior wiring of the female connector head 78 of FIG. 14 and the prior art 2-port assembly 18 of FIG. 3 clearly shows the simplified and more readily assembled structure of the female connector head 78. The connector head 78 of the invention eliminates the need for the jumper wires 58 as seen in prior art FIG. 3. Further, only five discrete terminals, that is, one of the ground female terminals 150 and four of the female terminals 104 are necessary to provide socket connections in both of the ports 100 and 106 as is clearly seen in FIG. 14. In the prior art 2-port assembly 18 of FIG. 3, it is necessary to employ five double-crimped socket terminals 44 and five single-crimped socket terminals 60 in the respective ports 40 and 42 as is also seen with reference to prior art FIG. 4.

As is also readily seen in FIG. 14, the location tab 166 formed on the ground female terminal 150 drops into the notch 170 on assembly of the terminal 150 onto the base 112 as will be further described relative to FIGS. 15A, 15B and 15C. As can also be seen in FIG. 14, the cable 80 is mounted to the base 112 by means of a cable retention strap 182 held in place by screws 184, which screws 184 are respectively received into threaded screw bosses 186 which are molded into the base 112. Further details of the structure which allows entry of the cable 80 into the housing 110 will be described in detail hereinafter.

FIG. 14 also shows oppositely aligned pairs of slots 188, 190, 192 and 194, the pair of slots 188 located at the end of the base 112 which receives the cable 80 opening into the interior of the base 112 at locations spaced from the periphery of said base 112. In a similar fashion, the pair of slots 194 at the opposite end of the base 112 open into the interior of the base 112, and thus of the housing 110, and are spaced from the periphery of said base. The two pairs of slots 190 and 192 located medially of the base 112 are disposed at the periphery of the base 112 but still open into the interior of the housing 110. The pairs of slots 188, 190, 192 and 194 allow insertion of a tool as will be further described hereinafter to disengage structure to be described hereinafter on the cover 114 which snap-fits with locking hubs 196 located interiorly of the base 112 and in opposed, spaced relation from each slot of the pairs of slots, the locking nubs 196 forming structure which cooperates with structure on the cover 114 to rapidly and positively snap-fit the cover 114 to the base 112 as will be described hereinafter. Further description of the base 112 will be provided relative to FIGS. 16 through 20 which illustrate the base 112 without the complications of other structure.

Referring now to FIGS. 15A, 15B and 15C, the manner by which any one of the female terminals 104 and insulated wires 154 crimped thereto are assembled into the base 112 is illustrated. The ground female terminal 150 and the bare ground wire 160 crimped thereto is assembled in an identical fashion. As has been previously described, the barrel sockets 102 and 108 of any one of the female terminals 104 are disposed at right angles to each other. It is necessary when assembling the female terminal 104 to the base 112 to cause the barrel socket 102 to enter one of the terminal channels 124 in the tapping port 100 while the barrel socket 108 is caused to be disposed in supporting structure (as will be described hereinafter) of the branch circuit port 106. Since each of the terminal channels 124 is provided with a latching tab 198 which acts to hold the terminal 104 in place during assembly, it is necessary to tilt the female terminal 104 as is shown in FIG. 15A prior to insertion of the socket 102 into the interior opening of the terminal channel 124. As is seen in FIG. 15B, the barrel socket 102 is inserted while tilted until the innermost end of the socket 102 moves past the latching tab 198. Once the socket 102 is past the latching tab 198, the terminal 104 can be pivoted to cause the socket 102 to be disposed within the channel 124 with the longitudinal axes of the socket 102 and of the channel 124 extending in the same direction or being coincident with each other. In this position as is seen in FIG. 15C, the latching tab 198 biases against an opposing portion of the socket 102 to hold the female terminal 104 in place during assembly. The function of the latching tab 198 is only needed during assembly of the connector head 78, it being necessary for the several female terminals 104 and for the ground female terminal 150 to remain in place as is shown in FIG. 15C during assembly of the cover 114 to the base 112 and further during assembly of the cable retainer strap 182 to fix the cable 80 onto the base 112. The cable 80 cannot be fixed to the base 112 until the terminals 104 and 150 are fixed in place to the base 112. Structure molded into the cover 114 and which will be described hereinafter acts to hold the barrel sockets 108 of the terminals 104 and the barrel socket 162 of the terminal 150 in place against forces which could cause dislodgement or displacement of said terminals 104 and 150 as will be hereinafter described. It is further to be seen in FIGS. 15A, 15B and 15C that each terminal channel 124 is surmounted by a slanted forward wall 200 which allows the terminals 104 and 150 to be inserted into said channels 124 by the assembly steps previously described.

Referring now to FIGS. 16 through 20, the base 112 is seen in plan and elevational views to have a forward portion 202 having substantially parallel perimetric walls 204 and 206, the base 112 tapering rearwardly to form an anterior portion 208 defined by perimetric walls 210 and 212 which angle toward each other and terminate in a rear wall 214. The walls 204, 206, 210, 212 and 214 are effectively joined together by a planar base portion 216 which is effectively disposed over the anterior portion 208 of the base 112. The boss portion 116 which has been previously described rises from the planar base portion 216 and provides a depth to the housing 110 which allows the terminals 104 and 150 to be received within the interior of the housing 110. The boss portion 116 tapers toward the front end of the base 112, it being possible to mold the base 112 with the external forward portion 202 having various structural designs which minimize the quantity of plastic material necessary for formation of the forward portion 202. In order to conserve material, the rectangular recess 118 can be defined by a forward wall 218 having tapering side walls 220 which extend to the front end of the base 112. The forward wall 218 and the tapering side walls 220 essentially define a recessed portion 222 which is recessed only for the purpose of conserving the material from which the base 112 is molded. The base 112 need only have a height dimension at the forward end thereof which, in combination with a forward portion of the cover 114 is capable of defining the recess 132 which effectively forms the branch circuit port 106 in combination with that structure disposed within the recess 132 as has been described hereinabove.

Figure 17:
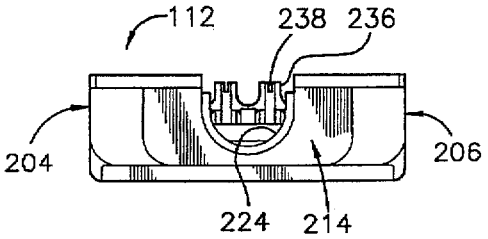
FIG. 17 is a rear elevational view of the base of the improved female connector head of the invention.
Figure 19:
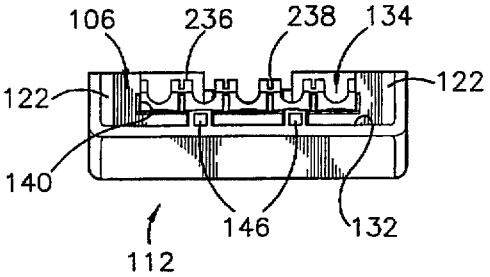
FIG. 19 is a front elevational view of the base.

As is best seen in FIGS. 16 and 17, a U-shaped opening 224 is formed in the rear wall 214 to facilitate reception of the cable 80, the cover 114 being configured as will be described hereinafter to completely define that opening through which the end of the cable 80 extends into the interior of the housing 110. Immediately interiorly of the opening 224 is a channel 226 having arcuate walls 228 molded with partial threads 230 formed in said walls 228 for receiving the end of the cable 80 thereinto. The partial threads 230 mate with portions of the outer surfaces of the end of the cable 80 and act to secure the end of the cable 80 within the channel 226 on assembly of the cable retainer strap 182 to the base 112 as aforesaid, the threads 230 engaging portions of the exterior surfaces of the cable 80 to prevent the cable 80 from being pulled out of the connector head 78.

The walls 204, 206, 210, 212, and 214 are substantially surmounted by perimeter strips 232 and 234 running along major portions of the tops of the walls on either side of the base 112. The perimeter strips 232 and 234 are discontinuous at the U-shaped opening 224 and do not extend fully to the forward end of the base 112. The perimeter strips 232 and 234 are recessed from the outer edges of the aforesaid walls of the base 112 so that the cover 114 can be fitted thereover as will be further described hereinafter.

As is best seen in FIG. 16, four interior walls 236 are molded with the base 112 and extend substantially parallel to the longitudinal axis of the base 112 with portions of the walls 236 lying between the terminal channels 124. The interior walls 236 each have an elongated groove 238 formed on the top of said walls to receive structure formed in the cover 114 as will be described hereinafter. The interior walls 236 act in concert with structure of the cover 114 as will be described hereinafter to define the interior housings 176 and a portion of the interior housing 174 as well as a portion of that housing 176 nearest to the wall 206 so that the terminals 104 and 150 are isolated from each other. Arcuate cradles 240 near the outermost ends of the walls 236 receive anterior portions of the barrel sockets 108 and of the barrel socket 162 of the respective female terminals 104 and 150 to cradle said sockets and thereby to facilitate holding of the sockets within the interior of the housing 112 when combined with corresponding structure in the cover 114 as will be described hereinafter. The arcuate cradles 240 lie immediately interiorly of the recess 132 of the branch circuit port 106.

As can be seen in FIGS. 16 and 18, the latching tabs 198 can be seen to be disposed in surmounting relation to the terminal channels 124 as described hereinabove. As also noted above, the latching tabs 198 are utilized during assembly to maintain the terminals 104 and 150 in place. As is best seen in FIGS. 16 and 18, that portion of each latching tab 198 extending essentially into the terminal channels 124 is arcuate to facilitate sliding of the barrel sockets 102 and 164 past the latching tabs 198 and then into said terminal channels 124. As is also best seen in FIG. 16, the slanted forward walls 200 disposed one each in surmounting relation to the anterior ends of the terminal channels 124 can be seen from an angle different from that seen in FIGS. 15A, 15B and 15C. As is also seen in FIG. 16, side walls 242 disposed on each side of each terminal channel 124 and located between the latching tabs 198 and the slanted forward wall 200 are seen to be angled, such as at an angle of 45°, to facilitate assembly of the terminals 104 and 150 into the terminal channels 124. The angle of the slanted forward walls 200 is slightly steeper than the angles of the side walls 242 in a preferred embodiment.

Referring now to FIGS. 21 through 25, the cover 114 can be best seen with additional reference to FIG. 15C which illustrates the assembly of the cover 114 to the base 112. The cover 114 has a perimetric shape as seen in FIGS. 21 and 23 which is substantially identical to the shape of the base 112. Walls 244 and 246 disposed along opposite sides of the cover 114 have planar top portions 248 and 250 respectively which are bounded by perimetric retainer strips 252 and 254 which extend along outer edges of the top portions 248, 250 of said walls 244, 246. The walls 244, 246 and the perimeter retaining strips 252, 254 are discontinuous along rear wall 256, an arcuate cutout 258 being formed in the rear wall 256. The arcuate cutout 258 cooperates with the U-shaped opening 224 in the rear wall 214 of the base 112 on assembly of the cover 114 to the base 112 to form that full opening in the housing 112 through which the end of the cable 80 is received.

The perimeter retention strips 252 and 254 extend about the remaining periphery of the cover 114 with the exception of the forwardmost portions of each of the walls 244 and 246. The planar top portions 248 and 250 which are discontinuous at the arcuate cutout 258 extend fully to the end of the cover 114 on either side thereof. The planar top portions 248, 250 of the walls 244, 246 contact and are retained on top portions of the perimeter strips 232, 234 formed with the base 112. The perimeter retaining strips 252, 254 of the cover 114 extend slightly downwardly along the perimeter strips 232, 234 respectively when the cover 114 is assembled to the base 112.

A bulging boss 260 is formed at the rear end of the cover 114 to complete the channel 226 formed in the base 112, thereby facilitating reception of the end of the cable 80 into the interior of the head 78.

Interior walls 262 which extend longitudinally of the cover 114 and being spaced from each other are provided one each with an elongated tongue 264, the tongue 264 fitting within a corresponding groove 238 in each of the interior walls 236 molded with the base 112, the interior walls 236 of the base 112 and the interior walls 262 of the cover 114 thus join to define the interior housings 176 and 174 as aforesaid thereby to separate the terminals 104 and 150 as well as the insulated wires 154 and 160 from each other within the interior of the head 78.

The cover 114 is further molded with five walls 266 which extend longitudinally of the cover 114 and lie immediately above the crimped portions of the terminals 104 and 150 and portions of the insulated wires 154 and 160 crimped to said terminals 104, 150. On assembly of the cover 114 to the base 112, the walls 266 extend nearly to said crimped portions of the terminals 104, 150 and wires 154, 160 to cause said terminals 104, 150 to remain in place even in the event of forces applied to the sockets 102 and 164 of the tapping port 100, the walls 266 thus acting to prevent vertical dislodgement or displacement of the terminals 104, 150 and associated wires 154, 160.

The walls 266 each have a retaining tab 268 formed thereon at a location such that each tab 268 drops into the cutouts 168 formed behind the barrel sockets 108, 162 to prevent dislodgement or displacement of said barrel sockets 108, 162. In essence, the retaining tabs 268 prevent the terminals 104, 150 from being pulled out of the branch circuit port 106 and the walls 266 prevent the terminals 104, 150 from being displaced from the tapping port 100. It is therefore to be recognized that the terminals 104 and 150 have no structure on the terminals per se which would prevent said terminals 104, 150 from being dislodged or displaced from their appropriate positions within the interior of the head 78. Only that structure molded into the base 112 and the cover 114 acts to prevent dislodgement or displacement of said terminals 104, 150.

The cover 114 is further seen in FIGS. 21, 24 and 25 to be provided with pairs of U-shaped locking tabs 272, 274, 276 and 278. In essence, the pair of locking tabs 272 located forwardly of the cover 114 are disposed in interior locations spaced from the perimeter of said cover 114 with the pair of locking tabs 278 at the opposite end of the cover 114 being similarly disposed in interior locations and spaced from the perimeter of the cover 114. The medial pairs of locking tabs 274 and 276 are disposed essentially at the periphery of the cover 114. The pairs of locking tabs 272, 274, 276 and 278 snap-fit onto the locking nubs 196 formed with the base 112 as aforesaid. The cover 114 is thus readily snap-fit onto the base 112. The interiorly disposed pairs of tabs 272 and 278 act in concert with the medial pairs of locking tabs 274 and 276 to prevent inadvertent dislodgement of any of the U-shaped locking tabs especially when the housing 110 is compressed centrally thereof on either side thereof such as can accidentally occur in use situations. Each locking tab of the pairs of locking tabs 272, 274, 276 and 278 has a slot 280 formed between respective legs of said locking tabs, the slots 280 facilitating insertion of tooling (not shown) during manufacture to produce a 7° angle on inner bight surfaces 281 as best seen in FIGS. 26A and 26B.

As is seen in FIGS. 26A and 26B, a tool can be inserted into the slots 188, 190, 192 and 194 formed in the base 112 to disengage each one of the locking tabs 272, 274, 276 and 278, the tool engaging said locking tab interiorly of the housing 110 and biasing said locking tab away from the corresponding locking hub 196 to cause the base 112 and the cover 114 to separate.

As can be seen in FIGS. 22 and 25, top portions of the locking tabs 272 and 278 are angled inwardly of the cover 114 while top portions of the locking tabs 274 and 276 are angled outwardly of the cover 114, these top portions of said locking tabs providing lead-in angles which facilitate latching of the cover 114 to the base 112. The slots 188, 190, 192 and 194 function also to facilitate insertion of tooling (not shown) during manufacture to produce angled surfaces 283 on the locking nubs 196, the surfaces 283 mating with the surfaces 281 of the tabs 272, 274, 276 and 278. Removal of the cover 114 from the base 112 is facilitated as aforesaid by the structure shown in FIGS. 26A and 26B through use of a tool. Further, the angled surfaces 281 and 283 act to tighten the assembly of the base 112 and the cover 114 when a force tending to pull the base 112 and the cover 114 apart is exerted on the housing 110.

The locations of the ground leg, neutral leg and hot legs 1, 2 and 3, are readily seen in FIGS. 16 and 18. FIG. 16 further shows the spring lock engaging tabs 122 disposed on opposite sides of the branch circuit port 106 while FIG. 18 shows the spring lock engaging tabs 120 disposed on either side of the tapping port 100. The cover 114, as seen in FIG. 21, also provides structure which forms a portion of the spring lock engaging tabs 122 formed in the branch circuit port 106, a portion of the tabs 122 being formed with the base 112 and a portion of said tabs 122 being formed with the cover 114, the respective portions of the tabs 122 mating on assembly of the cover 114 to the base 112 to form the complete structure of the tabs 122. Assembly of the cover 114 to the base 112 also causes the arcuate wall elements 142 formed with the cover 114 to be disposed in spaced relation to the U-shaped wall elements 140 formed in the base 112 to define those spaces within which the female barrel sockets 108 and 162 of the terminals 104, 150 are disposed.

The base 112 and the cover 114 are formed of impact-resistant, polymeric material which can take a variety of chemical forms. Particularly suitable polymeric materials include such materials which are fire-resistant as one example. As a further example, the material should be resistant to shattering or the like with durability being one primary characteristic for selection of an appropriate material.

While the invention has been described relative to a particular embodiment of a female connector head 78 and of a relocatable wiring system 76 improved by the provision of the head 78 therewithin, it is to be understood that the invention can be practiced other than as explicitly described and shown herein, the invention having a scope which is to be defined by the recitations of the appended claims.

What is claimed is:

1. In a relocatable wiring system having lengths of cable carrying circuit conductors and male connector heads each having pin terminals and female connector heads each having at least first and second ports with socket terminals disposed therein, each length of the cable having one of the male connector heads joined to one end thereof and one of the female connector heads being joined to the other end of the cable, the combination thus forming a basic structural unit of the wiring system, multiples of the basic unit being connected together to form branch circuits of the wiring system by connecting a male connector head of one of the units to the first port of a female connector head of an adjacent unit, the pin terminals of said male connector head being received by the socket terminals located in the port receiving said male connector head, the wiring system further including a pluggable connector joined to an electrical load such as a lighting fixture, the pluggable connector having pin terminals and being receivable by the other port of the female connector head to engage the pin terminals of the pluggable connector with the socket terminals of the other port to electrically connect the electrical load to a circuit formed at least in part by a given one of the circuit conductors carried by the cable, the female connector head being improved and thereby improving the wiring system, the improvement comprising:

a housing connected to and receiving an end of the cable thereinto at one end of the housing, ends of the circuit conductor extending from the end of the cable into the interior of the housing, the first port being located at a first location of the housing and the second port being located at a second location of the housing in proximity to the first port, the first and second ports being disposed out of plane with each other and at an angular relation to each other; and, electrical terminal means disposed within the housing and carried by at least one of the circuit conductors for electrical and mechanical connection to at least one of the circuit conductors, the electrical terminal means carrying the socket terminals disposed in the first and second ports, the electrical terminal means comprising at least one electrically conductive terminal element electrically connected to one of the circuit conductors, the terminal element carrying one of the socket terminals disposed in the first port and one of the socket terminals disposed in the second port.

2. In the improvement of claim 1 wherein the first and second ports are disposed at an angle of approximately 90° with respect to each other.

3. In the improvement of claim 1 wherein the first port is located at an end of the housing opposite said first-mentioned end, the cable being aligned with the socket terminals in the first port and extending in the same direction as said socket terminals disposed in the first port when in use.

4. In the improvement of claim 1 wherein the socket terminal disposed in the first port is carried by the terminal element at an angle relative to the socket terminal disposed in the second port.

5. In the improvement of claim 4 wherein the angle between the socket terminals is approximately 90°.

6. In the improvement of claim 4 wherein the terminal element comprises a bent medial portion, the respective socket terminals being joined to or being integrally formed with said medial portion.

7. In the improvement of claim 4 wherein the angle between the socket terminals is essentially the same as that angle of the angular relation between the first and second ports.

8. In the improvement of claim 7 wherein the angle between the socket terminals is approximately 90°.

9. In the improvement of claim 1 wherein the terminal element comprises crimping means carried thereby for connecting the terminal element to the circuit conductor.

10. In the improvement of claim 1 wherein a plurality of the terminal elements are disposed within the housing, one each of the terminal elements being joined to one each of the circuit conductors, one of the terminal elements and the associated conductor comprising a neutral leg, one of the terminal elements comprising a ground leg and at least one of the terminal elements comprising a hot leg.

11. In the improvement of claim 10 wherein the socket terminals of the terminal element comprising the ground leg are of a greater length than the socket terminals of the remaining terminal elements.

12. In the improvement of claim 10 wherein the terminal element carrying the ground leg has a location tab disposed thereon which is received by a recess formed in the housing to prevent location of the terminal element carrying the ground leg in any other than that location intended for said terminal element carrying the ground leg.

13. In the improvement of claim 1 wherein the housing is formed with keying slots in association with each of the ports and keyed to both the male connector head and the pluggable connector, thereby allowing either the male connector head or the pluggable connector to be received in each of the ports.

14. In the improvement of claim 1 wherein the housing comprises a base and a cover, said base and cover having molded therewith first means on said base and second means on said cover, said first and second means cooperating on assembly of the base and cover together for defining a space internally of the housing formed by said first and second means, said space receiving said electrical terminal means.

15. In the improvement of claim 1 wherein the housing comprises a base and a cover, said cover having molded therewith retention means on said cover, said retention means acting on assembly of the base and cover together for preventing displacement of the socket terminals of the terminal means disposed in the first port from said first port.

16. In the improvement of claim 15 wherein at least one of the socket terminals disposed in the first port has a cutout formed therein in proximity to the connection location of the socket terminal to one of the circuit conductors, the retention means comprising a retaining tab molded in the cover which drops into the cutout on assembly of the base and cover together to prevent displacement of the socket terminal from the first port.

17. In the improvement of claim 1 wherein the housing comprises a base and a cover, said cover having molded therewith retention means on said cover, said retention means acting on assembly of the base and cover together for preventing displacement of the socket terminals of the terminal means disposed in the second port from said second port.

18. In the improvement of claim 17 wherein the retention means comprise at lest one wall element formed in the cover, each wall element surmounting one of the socket terminals on assembly of the base and cover and extending into proximity thereto to prevent displacement of the socket terminal.

19. In the improvement of claim 1 wherein the housing comprises a base and a cover, said base having at least one terminal channel formed therein in the second port, holding means being molded in the base in surmounting relation to the terminal channel interiorly of the base for holding a socket terminal of the terminal means in the second port after said socket terminal is inserted into said terminal channel, the holding means acting to maintain the terminal means in place on the base during assembly of the female connector head.

20. In the improvement of claim 19 wherein the holding means molded in the base comprises a latching tab which extends partially into the terminal channel at an inner end thereof to block dislodgement of the terminal means once the terminal means is fitted in place on the base.

21. In the improvement of claim 19 wherein at least certain walls of the terminal channel are angled to allow the socket terminal received thereinto to be received without blockage thereof by the holding means, the socket terminal being tilted to be received within the terminal channel between the holding means and the angled walls.

22. In the improvement of claim 21 wherein the holding means is formed with an arcuate contour opposing at least portions of the angled walls to facilitate insertion of the socket terminal into the terminal channel.

23. In the improvement of claim 1 wherein the housing comprises a base and a cover, said base and cover having molded therewith first perimetric means on said base and second perimetric means on said cover, said first and second means cooperating on assembly of the base and cover together for seating of the base and cover together about the respective perimeters of the base and cover.

24. In the improvement of claim 1 wherein the housing comprises a base and a cover, said base and cover having molded therewith first cooperating means on said base and second cooperating means on said cover, the first and second cooperating means cooperating on assembly of the base and cover together for snap-fit latching of the base and cover together.

25. In the improvement of claim 24 wherein the first cooperating means on the base comprises latching nubs formed at selected locations of the base and positioned to cooperate with the second cooperating means on the cover, said second cooperating means comprising U-shaped snap-fitting elements each of which engage one of the latching hubs on assembly of the base and cover together.

26. In the improvement of claim 25 wherein each combination of latching nub and snap-fitting element comprises a snap-fit connector, certain pairs of the snap-fit connectors being disposed about the periphery of the housing and interiorly of the housing with each snap-fit connector of each pair being located oppositely across the housing from each other, certain other pairs of the snap-fit connectors being disposed in spaced relation to side walls of the housing and thus being located interiorly of the housing, the snap-fit connectors providing positive interconnection between the base and the cover.

27. In the improvement of claim 26 wherein each pair of snap-fit connectors disposed in spaced relation to the side walls of the housing are disposed one each at either end of the housing and the pairs of the snap-fit connectors located about the periphery of the housing are disposed between the said pairs of snap-fit connectors spaced from the periphery of the housing and are spaced from the interiorly disposed pairs of snap-fit connectors to prevent inadvertent opening of the housing on imposition of pressure on the housing at locations substantially centrally of external surfaces of said housing.

28. The connector head of claim 1 wherein the electrical terminal means comprise at least one electrically conductive terminal body electrically connected to said at least one circuit conductor, the terminal body carrying one of the socket terminals disposed in the first port and one of the socket terminals disposed in the second port, the socket terminals being carried by the terminal body at an angle substantially equal to the angle between the first and second ports.

29. The connector head of claim 28 wherein the socket terminals are integral portions of the electrically conductive terminal body, the socket terminals disposed in the first and second ports being carried by the at least one of the circuit conductors.

30. In the improvement of claim 1 wherein the socket terminals are integral portions of the electrical terminal means, the socket terminals of the electrical terminal means disposed in the first and second port being carried by the at least one of the circuit conductors.

31. In the improvement of claim 1 wherein the socket terminals disposed in the first and second ports are carried by the at least one of the circuit conductors.

32. A method for fabrication of a female connector head forming a portion of a relocatable wiring system, the head having a first port and a second port located on the head at an angled relation to each other, the head further having a housing connected to and receiving an end of a cable carrying circuit conductors, comprising the steps of:

forming an electrical terminal with first and second socket integral with said electrical terminal, the socket terminals being disposed at an angled relation to each other which is substantially the same as the angled relation between the first and second ports;

connecting one of the circuit conductors to the electrical terminal; and, disposing the first and second socket terminals respectively in the first and second ports, said socket terminals of said ports being electrically and mechanically connected to each other through said electrical terminal.

33. A connector head particularly useful in a relocatable wiring system and having at least first and second ports with mateable electrical terminal elements disposed in the ports, the terminal elements being connected to at least one circuit conductor extending into the connector head, comprising:

a housing connected to and receiving said at least one circuit conductor, the first port being located at a first location of the housing and the second port being located at a second location of the housing, the first and second ports being disposed out of plane with each other and at an angle relative to each other; and, electrical terminal means carried by the housing for electrical and mechanical connection to said at least one circuit conductor, the electrical terminal means carrying the terminal elements disposed in the first and second ports, the electrical terminal means comprising at least one electrically conductive terminal body electrically connected to said at least one circuit conductor, the terminal body carrying one of the terminal elements disposed in the first port and one of the terminal elements disposed in the second port, the terminal elements being carried by the terminal body at an angle substantially equal to the angle between the first and second ports.

34. The connector head of claim 33 wherein the terminal elements comprise socket terminals.

35. The connector head of claim 33 wherein the terminals are integral portions of the electrically conductive terminal body, the terminals disposed in the first and second ports being carried by the at least one of the circuit conductors.

36. The connector head of claim 33 wherein the terminals disposed in the first and second ports are carried by the at least one of the circuit conductors.

37. In a relocatable wiring system having lengths of cable carrying circuit conductors and first and second connector heads with one of said connector heads having first terminals and the other connector head having second terminals, the first and second terminals being mateable, one of the heads having at least first and second ports, each length of the cable having one of the connector heads joined to one end thereof and one of the other connector heads being joined to the other end of the cable, the combination thus forming a basic structural unit of the wiring system, multiples of the basic unit being connected together to form branch circuits of the wiring system by connection of one head of one of the units to the first port of the other of the heads of an adjacent unit, the first terminals in one of the heads being electrically connectible to the second terminals in the other head, the wiring system further including a pluggable connector joined to an electrical load such as a lighting fixture, the pluggable connector having terminals mateable with the terminals in the second port of the other of the heads to electrically connect the electrical load to a circuit formed at least in part by a given one of the circuit conductors carried by the cable, the connector head carrying first and second ports being improved and thereby improving the wiring system, the improvement comprising:

a housing connected to and receiving an end of the cable at one end of the housing, ends of the circuit conductors extending from the end of the cable and being carried by the housing, the first port being located at a first location of the housing and the second port being located at a second location of the housing, the first and second ports being disposed out of plane with each other and at an angle relative to each other; and, electrical terminal means comprising at least one electrically conductive terminal element for electrical and mechanical connection to at least one of the circuit conductors, the electrical terminal element carrying one of the terminals disposed in the first port and one of the terminals disposed in the second port.

38. In the improvement of claim 37 wherein the electrically conductive terminal element comprises a bent medially disposed body portion, one of the terminals disposed in the first port being formed on one end of the body portion and the terminal disposed in the second port being formed on the other end of the body portion, the terminals at the ends of the body portion being carried thereby at an angle relative to each other.

39. A connector head particularly useful in a relocatable wiring system and having at least first and second ports with mateable electrical terminal elements disposed in the ports, the terminal elements being connected to at least one circuit conductor, comprising:

a housing connected to and receiving said at least one circuit conductor, the first port being located at a first location of the housing and the second port being located at a second location of the housing, the first and second ports being disposed out of plane with each other and at an angle relative to each other; and, electrical terminal means carried by the housing for electrical and mechanical connection to said at least one circuit conductor, the electrical terminal means carrying the terminal elements disposed in the first and second ports, the electrical terminal means comprising a bent medially disposed body portion, the terminal element disposed in the first port being disposed at one end of the body portion and the terminal element disposed in the second port being disposed at the other end of the body portion, the terminal elements at the ends of the body portion being carried thereby at an angle relative to each other.

40. The connector head of claim 39 wherein the housing comprises a base and a cover, said cover having molded therewith retention means on said cover, said retention means acting on assembly of the base and cover together for preventing displacement of the terminal elements of the terminal means disposed in the first port from said first port.

41. The connector head of claim 40 wherein at least one of the terminal elements disposed in the first port has a cutout formed therein in proximity to the connection location of the terminal element to one of the circuit conductors, the retention means comprising a retaining tab molded in the cover which drops into the cutout on assembly of the base and cover together to prevent displacement of the terminal element from the first port.

42. The connector head of claim 39 wherein the housing comprises a base and a cover, said cover having molded therewith retention means on said cover, said retention means acting on assembly of the base and cover together for preventing displacement of the terminal elements of the terminal means disposed in the second port from said second port.

43. The connector head of claim 42 wherein the retention means comprise at least one wall element formed in the cover, each wall element surmounting one of the terminal elements on assembly of the base and cover and extending into proximity thereto to prevent displacement of the terminal element.

44. The connector head of claim 39 wherein the housing comprises a base and a cover, said base having at least one terminal channel formed therein in the second port, holding means being molded in the base in surmounting relation to the terminal channel interiorly of the base for holding a terminal element of the terminal means in the second port after said terminal element is inserted into said terminal channel, the holding means acting to maintain the terminal means in place on the base during assembly of the connector head.

45. The connector head of claim 44 wherein the holding means molded in the base comprises a latching tab which extends partially into the terminal channel at an inner end thereof to block dislodgement of the terminal means once the terminal means is fitted in place on the base.

46. The connector head of claim 39 wherein a plurality of the terminal means are disposed within the housing, one each of the terminal means being joined to one each of the circuit conductors, one of the terminal means and the associated conductor comprising a neutral leg, one of the terminal elements comprising a ground leg and at least one of the terminal elements comprising a hot leg, the terminal elements of the terminal means comprising the ground leg being of a greater length than the terminal elements of the remaining terminal means.

47. The connector head of claim 39 wherein a plurality of the terminal means are disposed within the housing, one each of the terminal means being joined to one each of the circuit conductors, one of the terminal means and the associated conductor comprising a neutral leg, one of the terminal means comprising a ground leg and at least one of the terminal means comprising a hot leg, the terminal means comprising the ground leg having a location tab disposed thereon which is received by a recess formed in the housing to prevent location of the terminal means comprising the ground leg in any other than that location intended for said terminal means comprising the ground leg.

48. The connector head of claim 39 wherein the housing comprises a base and a cover, said base having at least one terminal channel formed therein in the second port, holding means being molded in the base in surmounting relation to the terminal channel interiorly of the base for holding one of the terminal elements of the terminal means in the second port after said terminal element is inserted into said terminal channel, the holding means acting to maintain the terminal means in place on the base during assembly of the connector head, at least certain walls of the terminal channel being angled to allow the terminal element received thereinto to be received without blockage thereof by the holding means, the terminal element being tilted to be received within the terminal channel between the holding means and the angled walls.

49. The connector head of claim 48 wherein the holding means is formed with an arcuate contour opposing at least portions of the angled walls to facilitate insertion of the terminal element into the terminal channel.

50. In a relocatable wiring system having lengths of cable carrying circuit conductors and male connector heads each having first terminals and female connector heads each having at least first and second ports with second terminals disposed therein, the first and second terminals being matable for electrical connection therebetween, each length of the cable having one of the male connector heads joined to one end thereof and one of the female connector heads joined to the other end of the cable, the combination thus forming a basic structural unit of the wiring system, multiples of the basic unit being connected together to form branch circuits of the wiring system by connecting a male connector head of one of the units to the first port of a female connector head of an adjacent unit, the first terminals of said male connector head being received by the second terminals located in the port of the female connector head receiving said male connector head, the wiring system further including a pluggable connector joined to an electrical load such as a lighting fixture, the pluggable connector having terminals and being receivable by the other port of the female connector head to engage the terminals of the pluggable connector with the second terminals of the other port to electrically connect the electrical load to a circuit formed at least in part by a given end of the circuit conductors carried by the cable, the female connector head being improved and thereby improving the wiring system, the improvement comprising:

a housing connected to and receiving an end of the cable thereinto at one end of the housing, ends of the circuit conductors extending from the end of the cable into the interior of the housing, the first port being located at a first location of the housing and the second port being located at a second location of the housing in proximity to the first port, the first and second ports being disposed out of plane with each other and at an angular relation to each other; and, electrical terminal means disposed within the housing and carried by at least one of the circuit conductors for electrical and mechanical connection to at least one of the circuit conductors, the electrical terminal means carrying the second terminals disposed in the first and second ports, the electrical terminal means comprising at least one electrically conductive terminal element electrically connected to one of the circuit conductors, the terminal element carrying one of the second terminals disposed in the first port and one of the second terminals disposed in the second port.

51. In the improvement of claim 50 wherein the second terminals are integral portions of the electrical terminal element, the second terminals of the electrical terminal element disposed in the first and second ports being carried by the at least one of the circuit conductors.

52. In the improvement of claim 50 wherein the terminal element comprise a bent medially disposed body portion, the second terminals disposed in the first and second ports being respectively disposed at least one each at each end of the body portion, the second terminals at the ends of the body portion being carried thereby at an angle relative to each other.

53. In the improvement of claim 52 wherein the second terminals are integral portions of the body portion, the second terminals disposed in the first and second ports being carried by the at least one of the circuit conductors.

54. In a relocatable wiring system having lengths of cable carrying circuit conductors and male connector heads each having pin terminals and female connector heads each having at least first and second ports with socket terminals disposed therein, each length of the cable having one of the male connector heads joined to one end thereof and one of the female connector heads being joined to the other end of the cable, the combination thus forming the basic structural unit of the wiring system, multiples of the basic unit being connected together to form branch circuits of the wiring system by connecting a male connector head of one of the units to the first port of a female connector head of an adjacent unit, the pin terminals of said male connector head being received by the socket terminals located in the port receiving said male connector head, the wiring system further including a pluggable connector joined to an electrical load such as a lighting fixture, the pluggable connector having pin terminals and being receivable by the other port of the female connector head to engage the pin terminals of the pluggable connector with the socket terminals of the other port to electrically connect the electrical load to a circuit formed at least in part by a given one of the circuit conductors carried by the cable, the female connector head being improved and thereby improving the wiring system, the improvement comprising:

a housing connected to and receiving an end of the cable thereinto at one end of the housing, ends of the circuit conductors extending from the end of the cable into the interior of the housing, the first port being located at a first location of the housing and the second port being located at a second location of the housing, the first and second ports being disposed out of plane with each other and at an angular relation to each other, the housing comprising a base and a cover, said base having at least one terminal channel formed therein in the second port;

electrical terminal means disposed within the housing and carried by at least one of the circuit conductors for electrical and mechanical connection to at least one of the circuit conductors, the electrical terminal means carrying the socket terminals disposed in the first and second ports; and, holding means molded in the base in surmounting relation to the terminal channel interiorly of the base for holding a socket terminal of the terminal means in the second port after said socket terminal is inserted into said terminal channel, the holding means acting to maintain the terminal means in place on the base during assembly of the female connector head, at least certain walls of the terminal channel being angled to allow the socket terminal received thereinto to be received without blockage thereof by the holding means, the socket terminal being tilted to be received within the terminal channel between the holding means and the angled walls.

55. In the improvement of claim 54 wherein the holding means is formed with an arcuate contour opposing at least portions of the angled wall to facilitate insertion of the socket terminal into the terminal channel.

* * * * *